US010246234B2

(12) United States Patent
Prince et al.

(10) Patent No.: US 10,246,234 B2
(45) **Date of Patent: *Apr. 2, 2019**

(54) PACKAGING SHEET FOR BOX OR WRAPPING

(71) Applicants: Jennifer Prince, San Jose, CA (US); Kenneth B. Prince, San Jose, CA (US)

(72) Inventors: Jennifer Prince, San Jose, CA (US); Kenneth B. Prince, San Jose, CA (US)

(73) Assignee: FIVE LITTLE PRINCES DEVELOPMENT, LLC, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/805,986

(22) Filed: Nov. 7, 2017

(65) Prior Publication Data

US 2018/0170636 A1 Jun. 21, 2018

Related U.S. Application Data

(63) Continuation-in-part of application No. 29/588,242, filed on Dec. 19, 2016, and a continuation-in-part of
(Continued)

(51) Int. Cl.
*B65D 65/10* (2006.01)
*B65D 5/42* (2006.01)
(Continued)

(52) U.S. Cl.
CPC ..... *B65D 65/10* (2013.01); *B65D 5/0218* (2013.01); *B65D 5/0227* (2013.01);
(Continued)

(58) Field of Classification Search
CPC ..... B65D 65/02; B65D 5/4266; B65D 5/10; B65D 5/0227; B65D 5/0236
(Continued)

(56) References Cited

U.S. PATENT DOCUMENTS 2,365,704 A 1/1942 James
2,761,611 A * 9/1956 Benschoter ..... B65D 5/10 229/110
(Continued)

OTHER PUBLICATIONS

International Search Report and Written Opinion issued by the US ISA regarding related International Application No. PCT/US15/66102, dated Jan. 19, 2018, 10 pages.
(Continued)

*Primary Examiner* — Christopher Demeree
(74) *Attorney, Agent, or Firm* — Haynes and Boone, LLP

(57) ABSTRACT

A packaging sheet for wrapping an article or object, providing structure around the article or object, or forming a box. The packaging sheet includes first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel. The packaging sheet also includes first, second, third, and fourth flaps connected to the first, second, third and fourth panels, respectively. In some embodiments, a first edge is defined between the third and fifth panels so that the fifth panel is adjoined to the third panel along the first edge, and the fifth panel defines second and third edges along which no flaps are adjoined.

30 Claims, 18 Drawing Sheets

Related U.S. Application Data application No. 29/607,258, filed on Jun. 12, 2017, which is a continuation-in-part of application No. 15/383,761, filed on Dec. 19, 2016, now Pat. No. 9,708,111.

(51) Int. Cl.
*B65D 5/02* (2006.01)
*B65D 75/08* (2006.01)

(52) U.S. Cl.
CPC ..... *B65D 5/4266* (2013.01); *B65D 75/08* (2013.01); *B65D 5/029* (2013.01); *B65D 5/0272* (2013.01)

(58) Field of Classification Search
USPC ..... 229/115, 110, 108, 122.34, 132, 136, 229/198.2
See application file for complete search history.

(56) References Cited

U.S. PATENT DOCUMENTS

| | | | | |
|---|---|---|---|---|
| 2,826,350 | A * | 3/1958 | Marx | B65D 5/0254 229/110 |
| 3,237,841 | A | 3/1966 | Ridgeway, Jr. | |
| 3,341,349 | A | 9/1967 | Feeney | |
| D257,718 | S | 12/1980 | Dutcher | |
| 4,392,601 | A | 7/1983 | Fujikawa | |
| D286,987 | S | 12/1986 | Golan | |
| D289,263 | S | 4/1987 | Rusnock | |
| D346,553 | S | 5/1994 | Akerlind | |
| 5,338,943 | A | 8/1994 | Hendren | |
| 5,542,597 | A | 8/1996 | Richards | |
| 5,971,264 | A | 10/1999 | Karahoca | |
| D32,261 | S | 2/2000 | Colgan | |
| D436,534 | S | 1/2001 | Beaty | |
| 6,187,403 | B1 | 2/2001 | Richardson | |
| 6,604,674 | B1 | 8/2003 | Bowman | |
| D484,800 | S | 1/2004 | Hoffman | |
| D485,176 | S | 1/2004 | Hoffman | |
| D485,177 | S | 1/2004 | Hoffman | |
| D485,492 | S | 1/2004 | Hoffman | |
| D511,092 | S | 11/2005 | Shea | |
| 7,690,554 | B2 * | 4/2010 | Zacher | B65D 5/0227 229/109 |
| D635,851 | S | 4/2011 | Pipes | |
| D670,557 | S | 11/2012 | Hamina | |
| 8,783,546 | B2 | 7/2014 | Uyehara | |
| D720,989 | S | 1/2015 | Genender | |
| 1,177,410 | A1 | 3/2016 | Hatfield | |
| 9,365,337 | B2 | 6/2016 | Fullan | |
| D769,114 | S | 10/2016 | Montemayor | |
| D786,063 | S | 5/2017 | Choi | |
| 9,708,111 | B1 | 7/2017 | Prince | |
| D813,672 | S | 3/2018 | Doster | |
| 2003/0111521 | A1 | 6/2003 | Holmes | |
| 2006/0180642 | A1 * | 8/2006 | Zacher | B65D 5/0227 229/109 |
| 2007/0059477 | A1 | 3/2007 | Perelman et al. | |

OTHER PUBLICATIONS

Non Final Office Action issued by the USPTO regarding related U.S. Appl. No. 15/383,761 dated Feb. 24, 2017, 8 pages.
Notice of Allowance issued by the USPTO regarding related U.S. Appl. No. 15/383,761 dated May 22, 2017, 5 pages.
Office Action dated Jul. 25, 2018 from SIPO regarding Chinese Patent Application No. 201730630488.0, 3 pages.

* cited by examiner

PACKAGING SHEET FOR BOX OR WRAPPING

CROSS-REFERENCE TO RELATED APPLICATION

This application is a continuation-in-part (CIP) of U.S. Design application No. 29/607,258, filed Jun. 12, 2017, which is a continuation-in-part of U.S. Utility application Ser. No. 15/383,761, filed Dec. 19, 2016, now issued as U.S. Pat. No. 9,708,111, the entire disclosures of which are hereby incorporated herein by reference.

This application is a continuation-in-part (CIP) of U.S. Design application No. 29/588,242, filed Dec. 19, 2016, the entire disclosure of which is hereby incorporated herein by reference.

This application is related to U.S. Design application No. 29/625,172, filed Nov. 7, 2017, the entire disclosure of which is hereby incorporated herein by reference.

TECHNICAL FIELD

This disclosure relates in general to reusable gift packaging and, in particular, to a packaging sheet for a box or wrapping (e.g., a reusable gift box or reusable gift wrapping paper).

BACKGROUND

A gift, or present, is packaged inside a box, which box is then wrapped in a decorative wrapping material such as, for example, paper, plastic, or another fibrous or polymeric sheet material. The box may be in the shape of a rectangular prism. A sheet of the decorative wrapping material is measured and cut to match the size of the box. The decorative wrapping paper is then secured around the box using, for example, tape strips, and folded at opposing ends thereof to fully conceal the box. The box and decorative wrapping material operate to conceal the gift until such time as the recipient chooses to remove the decorative wrapping material and open the box. However, in some cases, packaging a gift in the manner described is inefficient in time and natural resources and, especially where the giver has limited gift packaging experience, leads to a low quality finished product having defects (e.g., torn or crumpled wrapping material). These difficulties are exacerbated when packaging multiple gifts, because the decorative wrapping material must be measured, cut, and folded to the correct size for each box. Additionally, the decorative wrapping material is not designed to be reused after the recipient opens the gift, but is instead meant to be immediately discarded. Therefore, what is needed is a method, apparatus, or kit that addresses one or more of these issues, and/or other issues.

BRIEF DESCRIPTION OF THE DRAWINGS

FIG. 1(*b*) is a perspective view of another structure (e.g., a box or another article or object) adapted to be wrapped (or formed) by a packaging sheet, the structure having another height, another width, and another length, according to one or more embodiments of the present disclosure.

FIG. 1(*c*) is a perspective view of yet another structure (e.g., a box or another article or object) adapted to be wrapped (or formed) by a packaging sheet, the structure having yet another height, yet another width, and yet another length, according to one or more embodiments of the present disclosure.

DETAILED DESCRIPTION

Figure 1A:
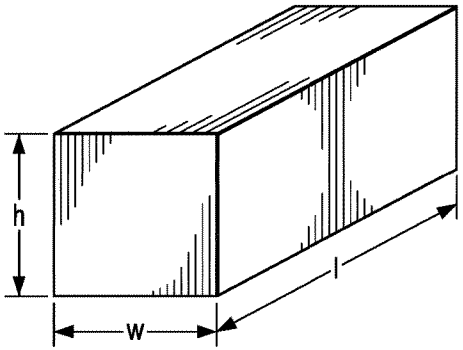
FIG. 1(*a*) is a perspective view of a structure (e.g., a box or another article or object) adapted to be wrapped (or formed) by a packaging sheet, the structure having a height, a width, and a length, according to one or more embodiments of the present disclosure.
Figure 1B:
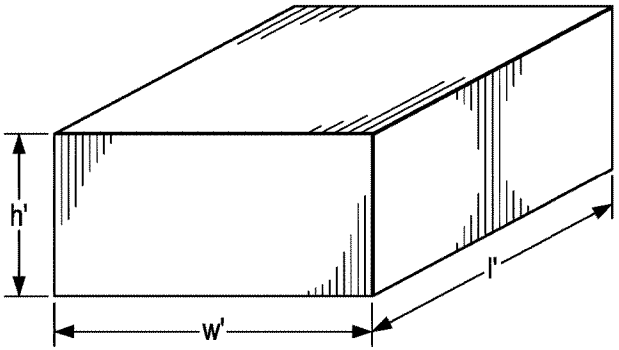
Figure 1C:
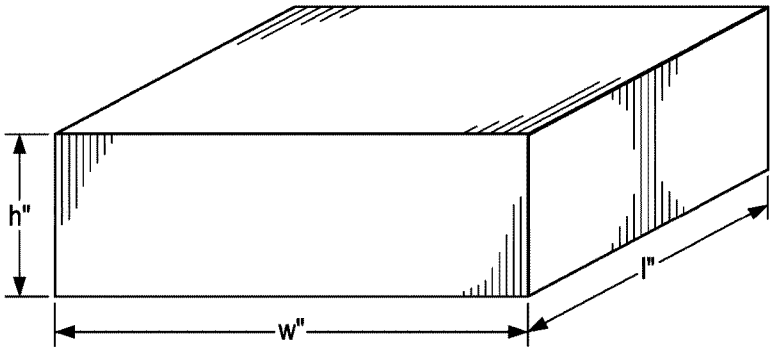

FIGS. 1(*a*)-(*c*) illustrate three (3) different-shaped structures (e.g., boxes or other articles or objects) that are each adapted to be wrapped, or formed, by a packaging sheet. A systematic or mathematical pattern is used to mark or cut the packaging sheet(s) according to the shape and size of a gift to be packaged. Alternatively, the packaging sheet(s) may be pre-cut (or pre-marked) in accordance with the disclosed systematic or mathematical pattern. The packaging sheet(s) are sized to efficiently wrap around an article or object, provide structure around the article or object, or form a box having a standard predetermined size such as, for example, the structures (e.g., boxes or other articles or objects) shown in FIGS. 1(*a*)-(*c*). The dimensions of the packaging sheet(s) are predetermined based on the dimensions of the article or object to be wrapped or structurally enclosed, or the box to be formed, as will be discussed in further detail below. In some embodiments, one or more of the packaging sheet(s) shown in FIGS. 2, 5-12, and 14-17 are foldable along the dashed lines to wrap the article or object, provide structure around the article or object, or form the box. In some embodiments, one or more of the packaging sheet(s) shown in FIGS. 2, 5-12, and 14-17 are scored along the dashed lines to better facilitate the folding of the packaging sheet(s) along the dashed lines.

More particularly, FIG. 1(*a*) illustrates the dimensions of an article or object to be wrapped or structurally enclosed, or a box to be formed, by a packaging sheet, said dimensions including a length l, a width w, and a height h. In the embodiment of FIG. 1(*a*), the width w is approximately equal to the height h (i.e., w≈h). The packaging sheets described below with reference to at least FIGS. 2, 3, 4(*a*)-(*f*), 5, 8-12, 13(*a*)-(*f*), and 14 can be made to fit (or form) any size article, object, or box where the width w is approximately equal to the height h (i.e., w≠h) such as, for example, the article, object, or box shown in FIG. 1(*a*). In some embodiments, the dimensions of one or more of the packaging sheets of FIGS. 2, 3, 4(*a*)-(*f*), 5, 8-12, 13(*a*)-(*f*), and 14 can be altered to work on an article, object, or box where the width w is greater than the height h and less than (or equal to) two-times the height h (i.e., h<w≤2 h).

Further, FIG. 1(*b*) illustrates the dimensions of an article or object to be wrapped or structurally enclosed, or a box to be formed, by another packaging sheet, said dimensions including a length l', a width w', and a height h'. In the embodiment of FIG. 1(*b*), the width w' is approximately two-times the height h' (i.e., w'≈2 h'). The packaging sheets described below with reference to FIGS. 6, 15, 17, and 18(*a*)-(*f*) can be made to fit any size article, object, or box where the width w' is approximately two-times the height h' (i.e., w'≈2 h') such as, for example, the article, object, or box shown in FIG. 1(*b*). In some embodiments, the dimensions of one or more of the packaging sheets of FIGS. 6, 15, 17, and 18(*a*)-(*f*) can be altered to work on an article, object, or box where the width w' is greater than the height h' and less than (or equal to) two-times the height h' (i.e., h'<w'≤2 h').

Finally, FIG. 1(*c*) illustrates the dimensions of an article or object to be wrapped or structurally enclosed, or a box to be formed, by yet another packaging sheet, said dimensions including a length l", a width w", and a height h". In the embodiment of FIG. 1(*c*), the width w" is approximately three-times the height h" (i.e., w"≈3 h"). The packaging sheets described below with reference to FIGS. 7 and 16 can be made to fit any size article, object, or box where the width w" is approximately three-times the height h" (i.e., w"≈3 h") such as, for example, the article, object, or box shown in FIG. 1(*c*). In some embodiments, the dimensions of one or more of the packaging sheets of FIGS. 7 and 16 can be altered to work on any article, object, or box where the width w" is greater than two-times the height h" (i.e., w">2 h").

Figure 2:
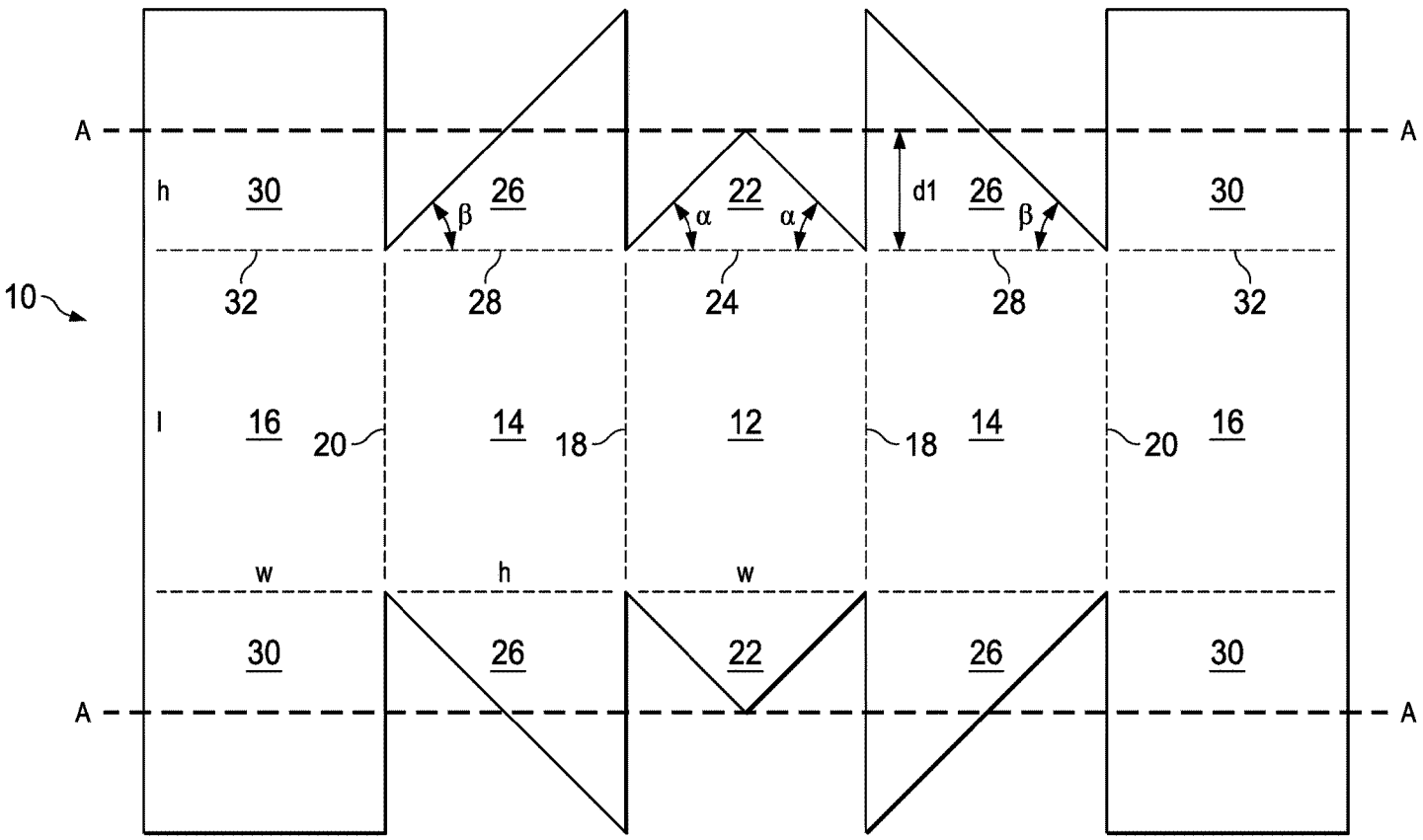
FIG. 2 is a plan view of a packaging sheet adapted to wrap the article or object, provide structure around the article or object, or form the box, of FIG. 1(*a*), according to one or more embodiments of the present disclosure.
Figure 3:
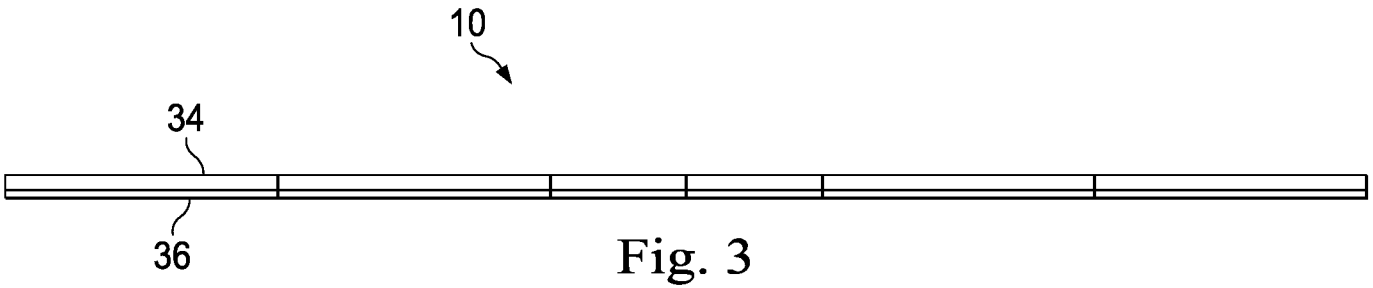
FIG. 3 is an elevational view of the packaging sheet of FIG. 2, the packaging sheet including a base layer and a laminate layer, according to one or more embodiments of the present disclosure.
Figure 4A:
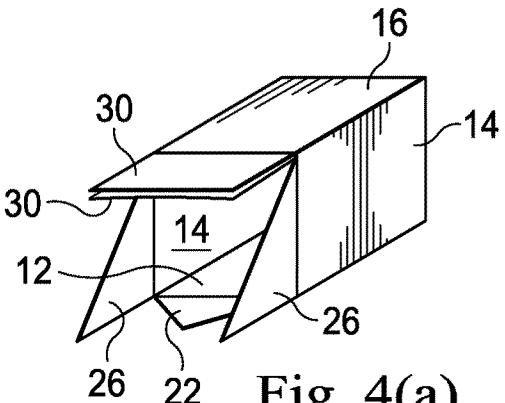
FIGS. 4(*a*)-(*f*) are perspective view of the packaging sheet of FIGS. 2 and 3 in first, second, third, fourth, fifth, and sixth stages of construction, respectively, to wrap the article or object, provide structure around the article or object, or form the box, of FIG. 1(*a*), according to one or more embodiments of the present disclosure.
Figure 4B:
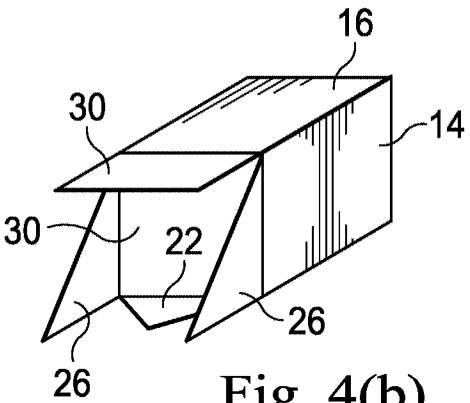
Figure 4C:
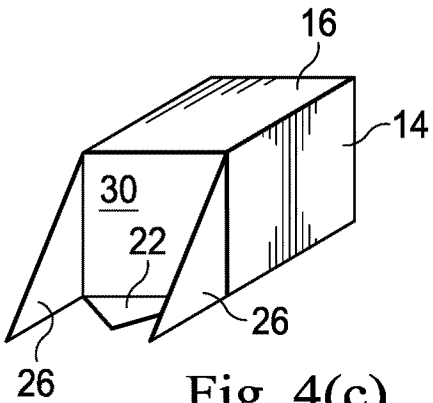
Figure 4D:
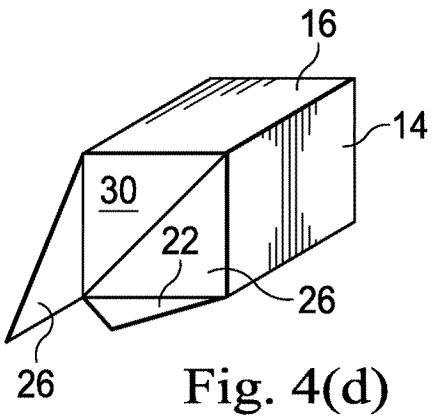
Figure 4E:
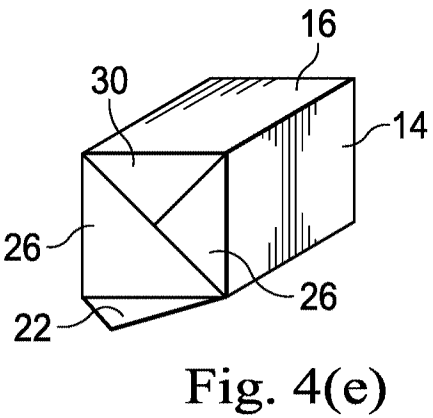
Figure 4F:
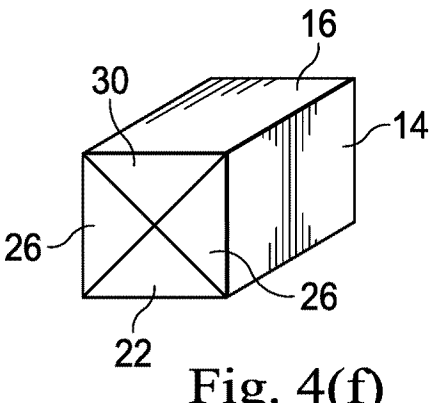

Referring to FIGS. 2, 3, and 4(*a*)-(*f*), an embodiment of a packaging sheet made to fit (or form) the article, object, or box shown in FIG. 1(*a*) is generally referred to by the reference numeral 10—however, although described herein with reference to the article, object, or box shown in FIG. 1(*a*), the dimensions of the packaging sheet 10 can be altered to fit any size article, object, or box where the width w is approximately equal to the height h (i.e., w≈h). The packaging sheet 10 includes a plurality of rectangular panels connected in series with one another. More particularly, a pair of opposing side panels 14 are connected to a centrally located bottom panel 12 and a pair of top panels 16 are connected to the respective side panels 14, opposite the bottom panel 12. The bottom panel 12 and the top panels 16 are substantially identical, each defining the length l and the width w. Moreover, the side panels 14 are substantially identical, each defining the length l and the height h. The side panels 14 are connected to the bottom panel 12 along respective edges 18 thereof that define the length l. Similarly, the top panels 16 are connected to the side panels 14 along respective edges 20 thereof that define the length l. Thus, the length l is a shared dimension between the bottom panel 12, the side panels 14, and the top panels 16.

In some embodiments, a pair of bottom flaps 22 are connected to the bottom panel 12, each including a pair of outer edges extending at angles α with respect to the adjoining edge of the bottom panel 12. In the embodiment of FIG. 2, the angles α are about 45 degrees and the bottom flaps 22 each define a triangular shape. In some embodiments, the angles α are between 40 degrees and 50 degrees. In some embodiments, the angles α are acute. The bottom flaps 22 are connected to the bottom panel 12 along respective edges 24 thereof that define the width w, which width is shared between the bottom flaps 22 and the bottom panel 12. In addition to the width w, the bottom flaps 22 each extend a distance d1 from the edge 24 to a distal portion thereof, the distance d1 being the lesser of: one-half the width w; and the height h.

Further, a pair of side flaps 26 are connected to each of the side panels 14, each including a long edge extending at an angle β with respect to the adjoining edge of the side panel 14, and a short edge extending at a 90-degree angle with respect to the adjoining edge of the side panel 14. In the embodiment of FIG. 2, the angles β are about 45 degrees and the side flaps 26 are triangular in shape. In some embodiments, the angles β are between 40 degrees and 50 degrees. In some embodiments, the angles β are acute. In some embodiments, the respective corners of the side flaps 26 defining the angles β are positioned adjacent the respective edges 20 between the side panels 14 and the top panels 16 and opposite respective corners of the top panels 16. In some embodiments, the respective short edges of the side flaps 26 extending at the 90-degree angles with respect to the adjoining edges of the side panels 14 (i.e., the short edges opposite the respective corners of the side flaps 26 defining the angles β) are substantially co-planar (or aligned) with the respective edges 18 between the bottom panel 12 and the side panels 14 when the packaging sheet 10 wraps the article or object, provides structure around the article or object, or forms the box. The side flaps 26 are connected to the respective side panels 14 along respective edges 28 thereof that define the height h, which height is shared between the side flaps 26 and the side panels 14. In addition to the height h, the side flaps 26 each extend a distance approximately equal to the height h from the edge 28 to a distal portion thereof.

Finally, a pair of top flaps 30 are connected to each of the top panels 16 along respective edges 32 thereof that define the width w, which width is shared between the top flaps 30 and the top panels 16. In addition to the width w, the top flaps 30 each extend a distance approximately equal to the height h from the edge 32 to a distal portion thereof. In the embodiment of FIG. 2, the top flaps 30 are rectangular in shape. In some embodiments, so long as the panels 12 and 16 are sized according to the length l and the width w, the panels 14 are sized according to the length l and the height h, and the angles α and β are each about 45 degrees, the packaging sheet 10 can be made to fit any size article, object, or box where the width w is approximately equal to the height h (i.e., w≈h).

Figure 5:
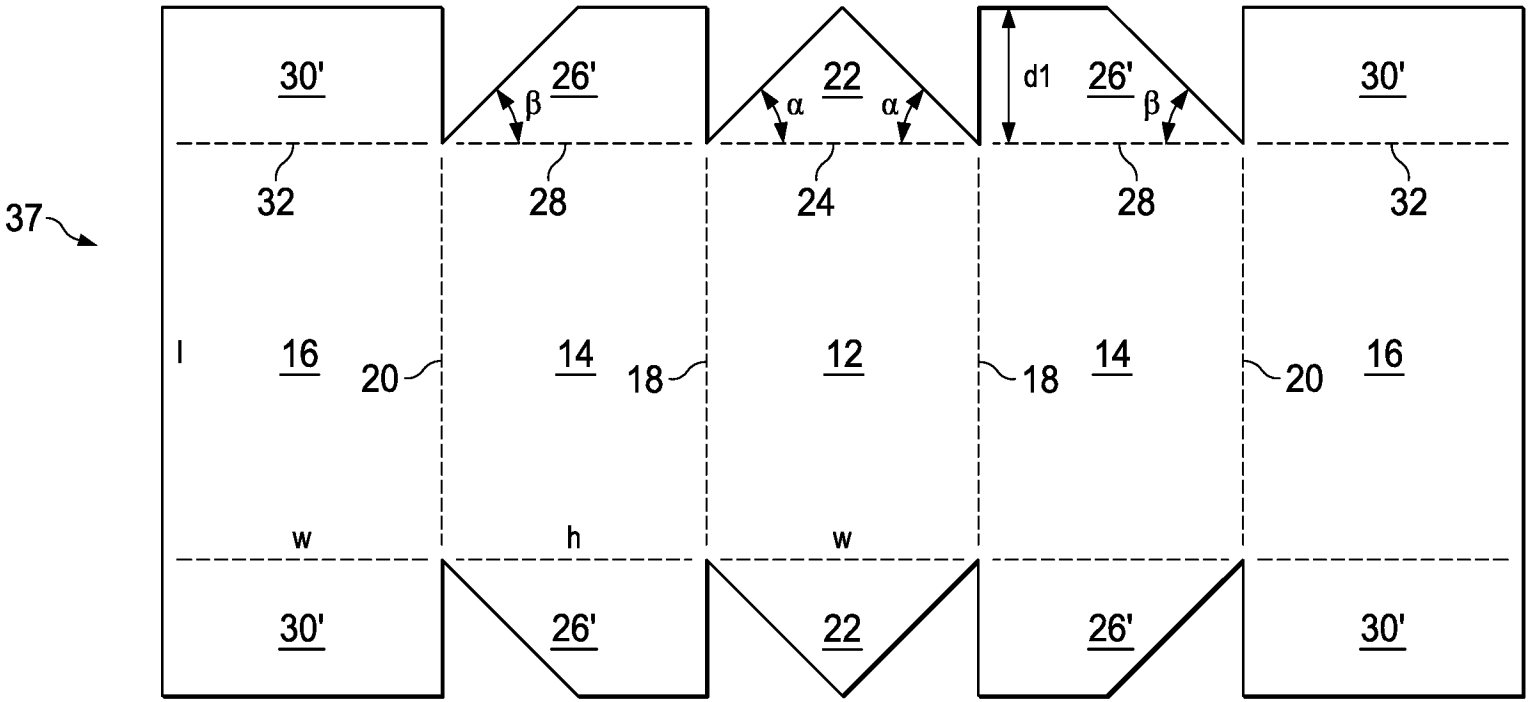
FIG. 5 is a plan view of another packaging sheet adapted to wrap the article or object, provide structure around the article or object, or form the box, of FIG. 1(*a*), according to one or more embodiments of the present disclosure.

In some embodiments, the side flaps 26 of the packaging sheet 10 are cut along respective lines A-A (shown in FIG. 2) so that the respective distal end portions of the resulting side flaps each define straight-cut lines (rather than points) and extend the distance d1 (rather than the height h) from the respective edges 28—as a result, the side flaps are trapezoidal in shape (shown pre-cut in FIG. 5). In some embodiments, the top flaps 30 of the packaging sheet 10 are cut along the respective lines A-A so that the respective distal end portions of the resulting top flaps each define straight-cut lines, and extend the distance d1 (rather than the height h) from the respective edges 32—as a result, the top flaps are oblong rectangular in shape (shown pre-cut in FIG. 5). In some embodiments, the side flaps 26 and the top flaps 30 of the packaging sheet 10 are cut along the respective lines A-A so that the respective distal end portions of the resulting side flaps and top flaps each define straight-cut lines and extend the distance d1 (rather than the height h) from the respective edges 28 and 32—as a result, the side flaps are trapezoidal in shape and the top flaps are oblong rectangular in shape (shown pre-cut in FIG. 5).

Turning to FIG. 3, the packaging sheet 10 may initially be in the form of a pre-cut (such as die-cut) two-dimensional sheet comprising a base layer 34 and a laminate layer 36 that is thermally adhered (or cold-pressed) to one side of the packaging sheet 10. The base layer 34 may be or include gift wrap, butcher paper, card stock, plastic, another fibrous or polymeric sheet material, or any combination thereof. In an embodiment, the laminate layer 36 defines a thickness of about 0.002-inches. In some embodiments, the laminate layer 36 defines a thickness ranging from about 0.001 inches to about 0.010 inches. In some embodiments, the packaging sheet 10 includes the laminate layer 36 thermally adhered (or cold-pressed) to one side of the packaging sheet 10, and another laminate layer (not shown) thermally adhered (or cold-pressed) to the other side of the packaging sheet 10. In an embodiment, the laminate layer 36 and the another laminate layer each define a thickness of about 0.002-inches. In some embodiments, the laminate layer 36 and the another laminate layer each define a thickness ranging from about 0.001 inches to about 0.010 inches. In some embodiments, one of the laminate layer 36 and the another laminate layer defines a thickness of about 0.002-inches, and the other of the laminate layer 36 and the another laminate layer defines a thickness ranging from about 0.001 inches to about 0.010 inches. The laminate layer 36 (and the another laminate layer) provides sufficient structural integrity to the base layer 34 so that the packaging sheet 10 can be reused. Thus, after the packaging sheet 10 has been used to package a gift and the gift has been unwrapped or taken out of the box, the packaging sheet 10 can be reused to package another gift. In those embodiments where only one side of the packaging sheet 10 is laminated, the laminate layer 36 is applied to the top of the decorative, or exterior, side of the base layer 34.

Turning to FIGS. 4(*a*)-(*f*), in operation, the packaging sheet 10 of FIGS. 2 and 3 is used to wrap the article or object, provide structure around the article or object, or form the box of FIG. 1(*a*). More particularly, the side panels 14 of the packaging sheet 10 are folded along the edges 18 at right-angles relative to the bottom panel 12. In a similar manner, the top panels 16 of the packaging sheet 10 are folded along the edges 20 at right-angles relative to the respective side panels 14. As a result, the top panels 16 overlap, align, and can be detachably connected to one another, so that the packaging sheet 10 forms a generally tubular shape defining opposing end portions. The packaging sheet 10 is illustrated in FIG. 4(*a*) forming the generally tubular shape with one of the opposing end portions thereof being enclosed by the corresponding bottom flap 22, side flaps 26, and top flaps 30. FIGS. 4(*b*) and (*c*) illustrate the other end portion of the tubular shape formed by the packaging sheet 10 being enclosed by first folding the top flaps 30 one after the other along the edges 32 at right-angles relative to the top panels 16 so that one of the top flaps 30 overlies the other of the top flaps 30. Next, as shown in FIGS. 4(*d*) and (*e*), the side flaps 26 are folded along the edges 28 at right-angles relative to the side panels 14, and are overlapped with the top flaps 30 and one another. As a result, the respective short edges of the side flaps 26 extending at the 90-degree angles with respect to the adjoining edges of the side panels 14 (i.e., the short edges opposite the respective corners of the side flaps 26 defining the angles β) extend along the edge 24 between the bottom panel 12 and the bottom flap 22. Finally, as shown in FIG. 4(*f*), the bottom flap 22 is folded along the edge 24 at a right-angle relative to the bottom panel 12, and is overlapped and detachably connected to one or more of the side flaps 26 and/or the overlying top flap 30. In some embodiments, the packaging sheet 10 may be used (or configured) to wrap another article or object having length, width, and height dimensions that are equal to, or less than, the length l, the width w, and the height h.

In some embodiments, at least one of the top panels 16 includes a cutout pattern or design (not shown), such as, for example, a die-cut pattern or design—in one such embodiment, the cutout pattern or design is formed in one of the top panels 16 so that the top panel 16 in which the cutout pattern or design is formed overlies the other top panel 16 when the packaging sheet wraps the article or object, provides structure around the article or object, or forms the box. As a result, the underlying top panel 16 is exposed, and thus visible, through the cutout pattern or design in the overlying top panel 16. In addition, or instead, a cutout pattern or design (not shown), such as, for example, a die-cut pattern or design, may be formed in the bottom panel 12 and/or at least one of the side panels 14. In some embodiments, colorful paper (or artwork) underlies at least one of the panels (e.g., the bottom panel 12, the side panels 14, or the top panels 16) in which the cutout pattern or design is formed so as to be exposed, and thus visible, through the cutout pattern or design.

Referring to FIG. 5, another embodiment of a packaging sheet made to fit (or form) the article, object, or box shown in FIG. 1(*a*) is generally referred to by the reference numeral 37—however, although described herein with reference to the article, object, or box shown in FIG. 1(*a*), the dimensions of the packaging sheet 37 can be altered to fit any size article, object, or box where the width w is approximately equal to the height h (i.e., w≈h). The packaging sheet 37 includes several features that are substantially identical to corresponding features of the packaging sheet 10, which identical features are given the same reference numerals. In some embodiments of the packaging sheet 37, the side flaps 26 are replaced with pre-cut side flaps 26' whose respective distal end portions each define straight-cut lines (rather than points) and extend the distance d1 (rather than the height h) from the respective edges 28. As a result, the side flaps 26' are trapezoidal in shape. In some embodiments of the packaging sheet 37, the top flaps 30 are replaced with pre-cut top flaps 30' whose respective distal end portions each define straight-cut lines and extend the distance d1 (rather than the height h) from the respective edges 32. As a result, the top flaps 30' are oblong rectangular in shape. In some embodiments of the packaging sheet 37 (one of which is shown in FIG. 5), the side flaps 26 are replaced with pre-cut side flaps 26' whose respective distal end portions each define straight-cut lines (rather than points) and extend the distance d1 (rather than the height h) from the respective edges 28, and the top flaps 30 are replaced with pre-cut top flaps 30' whose respective distal end portions each define straight-cut lines and extend the distance d1 (rather than the height h) from the respective edges 32. As a result, the side flaps 26' are trapezoidal in shape and the top flaps 30' are oblong rectangular in shape.

Figure 6:
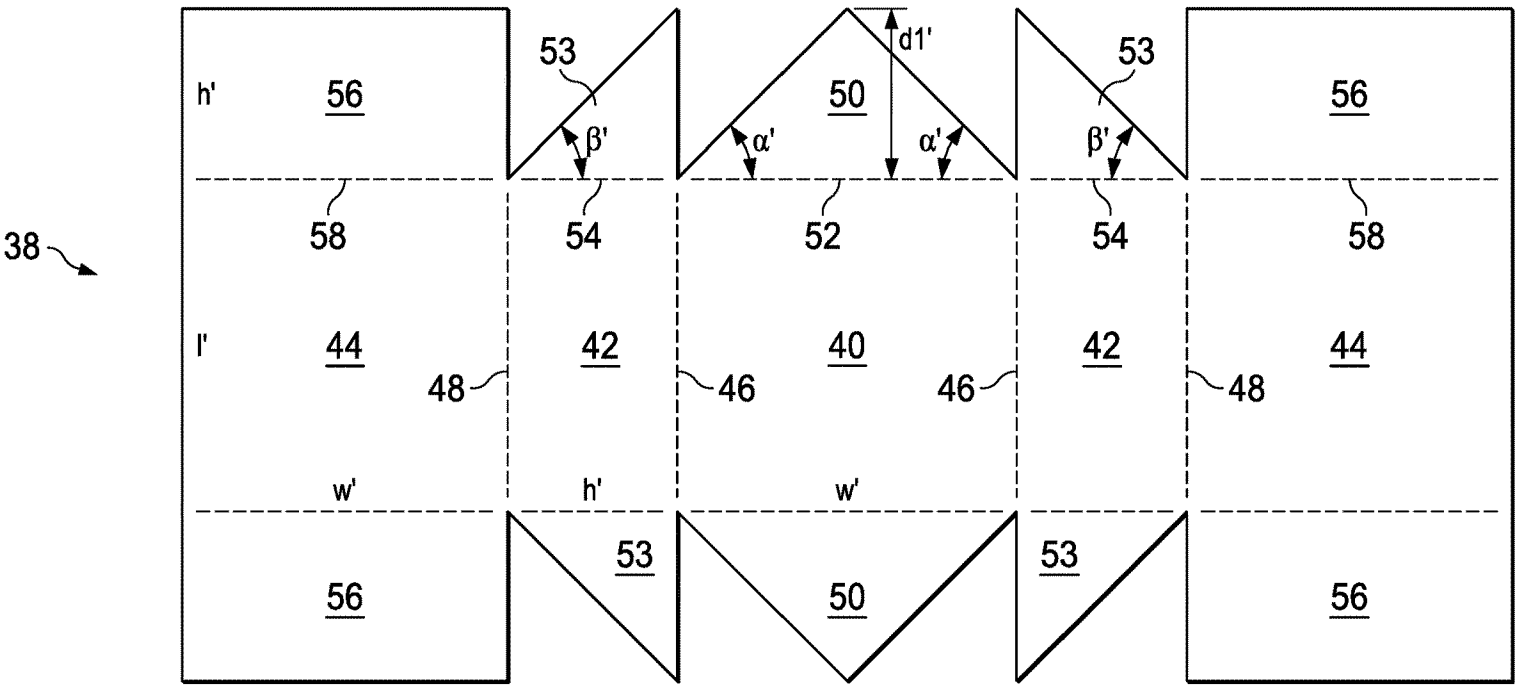
FIG. 6 is a plan view of a packaging sheet adapted to wrap the article or object, provide structure around the article or object, or form the box, of FIG. 1(*b*), according to one or more embodiments of the present disclosure.

Referring to FIG. 6, an embodiment of a packaging sheet made to fit (or form) the article, object, or box shown in FIG. 1(*b*) is generally referred to by the reference numeral 38—however, although described herein with reference to the article, object, or box shown in FIG. 1(*b*), the dimensions of the packaging sheet 38 can be altered to fit any size article, object, or box where the width w' is approximately two-times the height h' (i.e., w'≈2 h'). Moreover, the dimensions of the packaging sheet 38 can be altered to fit any size article, object, or box where the width w' is greater than the height h' and less than (or equal to) two-times the height h' (i.e., h'<w'≤2 h')—such a packaging sheet may end up looking different than the packaging sheet 38, but the methodology to make the systematic or mathematical pattern is the same. The packaging sheet 38 includes a plurality of rectangular panels connected in series with one another. More particularly, a pair of opposing side panels 42 are connected to a centrally located bottom panel 40, and a pair of top panels 44 are connected to the respective side panels 42, opposite the bottom panel 40. The bottom panel 40 and the top panels 44 are substantially identical, each defining the length l' and the width w'. Moreover, the side panels 42 are substantially identical, each defining the length l' and the height h'. The side panels 42 are connected to the bottom panel 40 along respective edges 46 thereof that define the length l'. Similarly, the top panels 44 are connected to the side panels 42 along respective edges 48 thereof that define the length l'. Thus, the length l' is a shared dimension between the bottom panel 40, the side panels 42, and the top panels 44.

In some embodiments, a pair of bottom flaps 50 are connected to the bottom panel 40, each including a pair of outer edges extending at angles α' with respect to the adjoining edge of the bottom panel 40. In the embodiment of FIG. 6, the angles α' are about 45 degrees and the bottom flaps 50 are triangular in shape. In some embodiments, the angles α' are between 40 degrees and 50 degrees. In some embodiments, the angles α' are acute. The bottom flaps 50 are connected to the bottom panel 40 along respective edges 52 thereof that define the width w', which width is shared between the bottom flaps 50 and the bottom panel 40. In addition to the width w', the bottom flaps 50 each extend a distance d1' from the edge 52 to a distal portion thereof, the distance d1' being the lesser of: one-half the width w'; and the height h'. In those embodiments where the width w' is approximately two-times the height h' (i.e., w'≈2 h'), the distance d1' is approximately equal to the height h' (i.e., x'≈h').

Further, a pair of side flaps 53 are connected to each of the side panels 42, each including a long edge extending at an angle β' with respect to the adjoining edge of the side panel 42, and a short edge extending at a 90-degree angle with respect to the adjoining edge of the side panel 42. In the embodiment of FIG. 6, the angles β' are about 45 degrees and the side flaps 53 are triangular in shape. In some embodiments, the angles β' are between 40 degrees and 50 degrees. In some embodiments, the angles β' are acute. In some embodiments, the respective corners of the side flaps 53 defining the angles β' are positioned adjacent the respective edges 48 between the side panels 42 and the top panels 44 and opposite respective corners of the top panels 44. In some embodiments, the respective short edges of the side flaps 53 extending at the 90-degree angles with respect to the adjoining edges of the side panels 42 (i.e., the short edges opposite the respective corners of the side flaps 53 defining the angles β') are substantially co-planar (or aligned) with the respective edges 46 between the bottom panel 40 and the side panels 42 when the packaging sheet 38 wraps the article or object, provides structure around the article or object, or forms the box. The side flaps 53 are connected to the respective side panels 42 along respective edges 54 thereof that define the height h', which height is shared between the side flaps 53 and the side panels 42. In addition, the side flaps 53 each extend a distance approximately equal to the height h' (and the distance d1') from the edge 54 to a distal portion thereof.

Finally, a pair of top flaps 56 are connected to each of the top panels 44 along respective edges 58 thereof that define the width w', which width is shared between the top flaps 56 and the top panels 44. In addition to the width w', the top flaps 56 each extend a distance approximately equal to the height h' from the edge 58 to a distal portion thereof. In the embodiment of FIG. 6, the top flaps 56 are oblong rectangular in shape. In some embodiments, so long as the panels 40 and 44 are sized according to the length l' and the width w', the panels 42 are sized according to the length l' and the height h', and the angles α' and β' are each about 45 degrees, the packaging sheet 38 can be made to fit any size article, object, or box where the width w' is greater than the height h' and less than two-times the height h' (i.e., h'<w'<2 h').

In operation, in an embodiment, the packaging sheet 38 is used to wrap an article or object, provide structure around the article or object, or form a box defining the length l', the width w', and the height h' in a manner similar to the manner in which the packaging sheet 10 is used to wrap the article or object, provide structure around the article or object, or form the box defining the length l, the width w, and the height h—therefore, the operation of the packaging sheet 38 will not be discussed in further detail. In some embodiments, the packaging sheet 38 may be used (or configured) to wrap another article or object having length, width, and height dimensions that are equal to, or less than, the length l', the width w', and the height h'.

Figure 7:
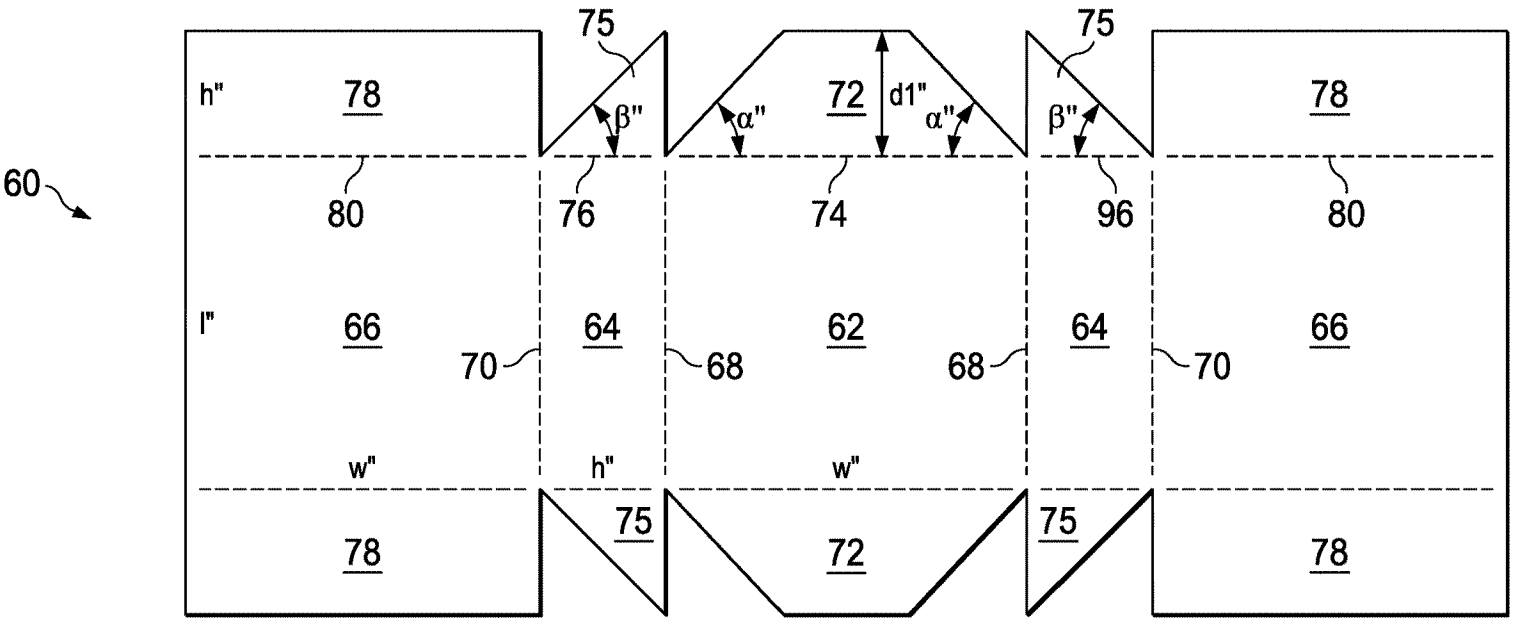
FIG. 7 is a plan view of a packaging sheet adapted to wrap the article or object, provide structure around the article or object, or form the box, of FIG. 1(*c*), according to one or more embodiments of the present disclosure.

Referring to FIG. 7, an embodiment of a packaging sheet made to fit (or form) the article, object, or box shown in FIG. 1(*c*) is generally referred to by the reference numeral 60—however, although described herein with reference to the article, object, or box shown in FIG. 1(*c*), the dimensions of the packaging sheet 60 can be altered to fit any size article, object, or box where the width w" is approximately three-times the height h" (i.e., w"≈3 h"). Moreover, the dimensions of the packaging sheet 60 can be altered to fit any size article, object, or box where the width w" is greater than two-times the height h" (i.e., w">2 h")—such a packaging sheet may end up looking different than the packaging sheet 60, but the methodology to make the systematic or mathematical pattern is the same. The packaging sheet 60 includes a plurality of rectangular panels connected in series with one another. More particularly, a pair of opposing side panels 64 are connected to a centrally located bottom panel 62, and a pair of top panels 66 are connected to the respective side panels 64, opposite the bottom panel 62. The bottom panel 62 and the top panels 66 are substantially identical, each defining the length l" and the width w". Moreover, the side panels 64 are substantially identical, each defining the length l" and the height h". The side panels 64 are connected to the bottom panel 62 along respective edges 68 thereof that define the length l". Similarly, the top panels 66 are connected to the side panels 64 along respective edges 70 thereof that define the length l". Thus, the length l" is a shared dimension between the bottom panel 62, the side panels 64, and the top panels 66.

In some embodiments, a pair of bottom flaps 72 are connected to the bottom panel 62, each including a pair of outer edges extending at angles α" with respect to the adjoining edge of the bottom panel 62. In the embodiment of FIG. 7, the angles α" are about 45 degrees and the bottom flaps 72 are trapezoidal in shape. In some embodiments, the angles α" are between 40 degrees and 50 degrees. In some embodiments, the angles α" are acute. The bottom flaps 72 are connected to the bottom panel 62 along respective edges 74 thereof that define the width w", which width is shared between the bottom flaps 72 and the bottom panel 62. In addition to the width w", the bottom flaps 72 each extend a distance d1' from the edge 74 to a distal portion thereof, the distance d1" being the lesser of: one-half the width w"; and the height h". In those embodiments where the width w" is approximately three-times the height h" (i.e., w"≈3 h"), the distance d1" is approximately equal to the height h" (i.e., x"≈h"). Additionally, since the width w" is greater than two-times the height h" (i.e., w">2 h"), the respective distal end portions of the bottom flaps 72 define straight-cut lines, rather than points.

Further, a pair of side flaps 75 are connected to each of the side panels 64, each including a long edge extending at an angle β" with respect to the adjoining edge of the side panel 64, and a short edge extending at a 90-degree angle with respect to the adjoining edge of the side panel 64. In the embodiment of FIG. 7, the angles β" are about 45 degrees and the side flaps 75 are triangular in shape. In some embodiments, the angles β" are between 40 degrees and 50 degrees. In some embodiments, the angles β" are acute. In some embodiments, the respective corners of the side flaps 75 defining the angles β" are positioned adjacent the respective edges 70 between the side panels 64 and the top panels 66 and opposite respective corners of the top panels 66. In some embodiments, the respective short edges of the side flaps 75 extending at the 90-degree angles with respect to the adjoining edges of the side panels 64 (i.e., the short edges opposite the respective corners of the side flaps 75 defining the angles β") are substantially co-planar (or aligned) with the respective edges 68 between the bottom panel 62 and the side panels 64 when the packaging sheet 60 wraps the article or object, provides structure around the article or object, or forms the box. The side flaps 75 are connected to the respective side panels 64 along respective edges 76 thereof that define the height h", which height is shared between the side flaps 75 and the side panels 64. In addition, the side flaps 75 each extend a distance approximately equal to the height h" (and the distance d1") from the edge 76 to a distal portion thereof.

Finally, a pair of rectangular top flaps 78 are connected to each of the top panels 66 along respective edges 80 thereof that define the width w", which width is shared between the top flaps 78 and the top panels 66. In addition to the width w", the top flaps 78 each extend a distance approximately equal to the height h" from the edge 80 to a distal portion thereof. In the embodiment of FIG. 7, the top flaps 78 are oblong rectangular in shape. In some embodiments, so long as the panels 62 and 66 are sized according to the length l" and the width w", the panels 64 are sized according to the length l" and the height h", and the angles α" and β" are each about 45 degrees, the packaging sheet 60 can be made to fit any size article, object, or box where the width w" is greater than two-times the height h" (i.e., w">2 h").

In operation, in an embodiment, the packaging sheet 60 is used to wrap an article or object, provide structure around the article or object, or form a box defining the length l", the width w", and the height h" in a manner similar to the manner in which the packaging sheet 10 is used to wrap the article or object, provide structure around the article or object, or form the box defining the length l, the width w, and the height h—therefore, the operation of the packaging sheet 60 will not be discussed in further detail. In some embodiments, the packaging sheet 60 may be used (or configured) to wrap another article or object having length, width, and height dimensions that are equal to, or less than, the length l", the width w", and the height h".

Figure 8:
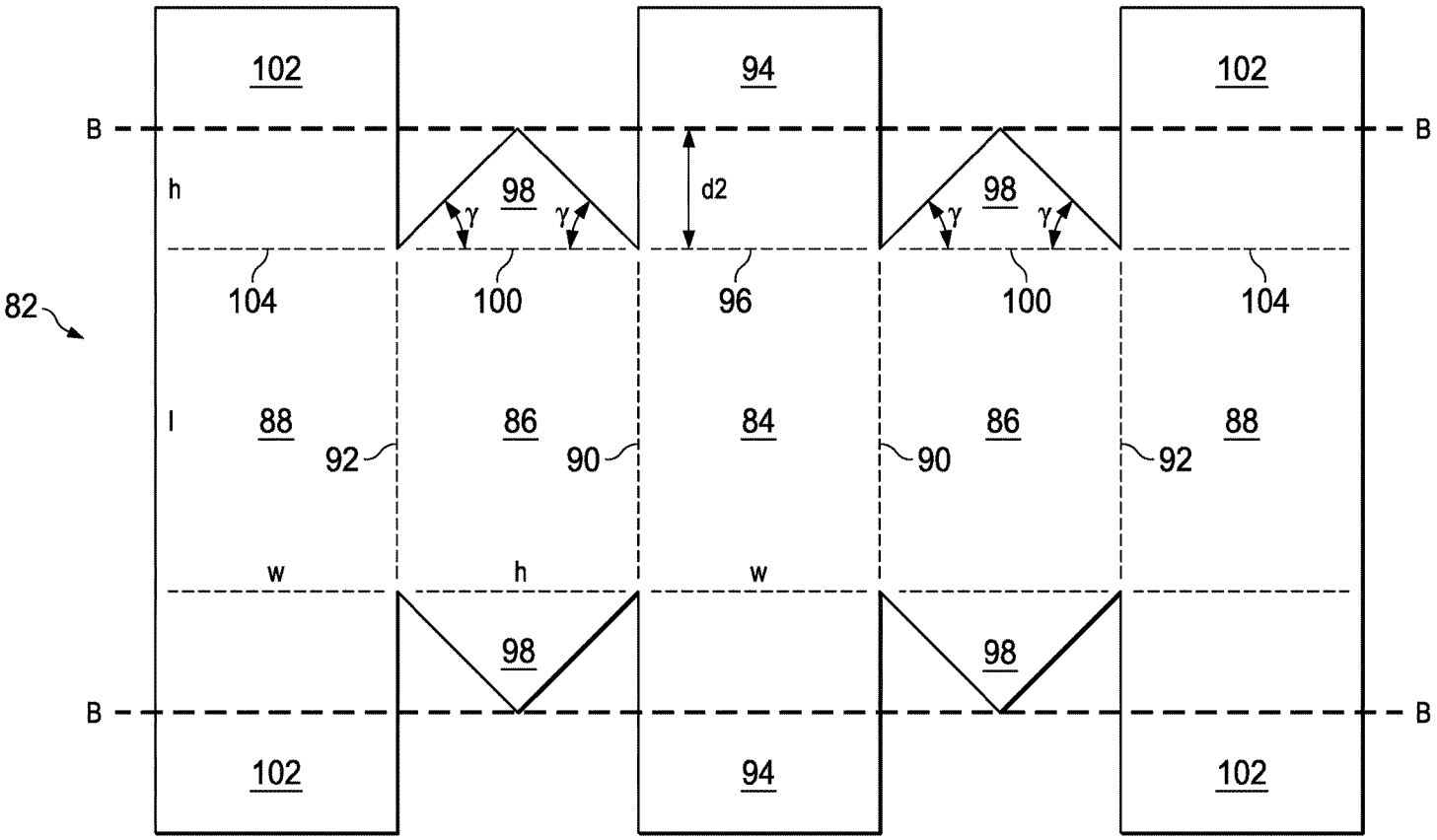
FIG. 8 is a plan view of yet another packaging sheet adapted to wrap the article or object, provide structure around the article or object, or form the box, of FIG. 1(*a*), according to one or more embodiments of the present disclosure.

Referring to FIG. 8, yet another embodiment of a packaging sheet made to fit (or form) the article, object, or box shown in FIG. 1(*a*) is generally referred to by the reference numeral 82—however, although described herein with reference to the article, object, or box shown in FIG. 1(*a*), the dimensions of the packaging sheet 82 can be altered to fit any size article, object, or box where the width w is approximately equal to the height h (i.e., w≈h). The packaging sheet 82 includes a plurality of rectangular panels connected in series with one another. More particularly, a pair of opposing side panels 86 are connected to a centrally located bottom panel 84, and a pair of top panels 88 are connected to the respective side panels 86, opposite the bottom panel 84. The bottom panel 84 and the top panels 88 are substantially identical, each defining the length l and the width w. Moreover, the side panels 86 are substantially identical, each defining the length l and the height h. The side panels 86 are connected to the bottom panel 84 along respective edges 90 thereof that define the length l. Similarly, the top panels 88 are connected to the side panels 86 along respective edges 92 thereof that define the length l. Thus, the length l is a shared dimension between the bottom panel 84, the side panels 86, and the top panels 88.

In some embodiments, a pair of bottom flaps 94 are connected to the bottom panel 84 along respective edges 96 thereof that define the width w, which width is shared between the bottom flaps 94 and the bottom panel 84. In addition to the width w, the bottom flaps 94 each extend a distance approximately equal to the height h from the edge 96 to a distal portion thereof. In the embodiment of FIG. 8, the bottom flaps 94 are rectangular in shape. Further, a pair of side flaps 98 are connected to each of the side panels 86, each including a pair of outer edges extending at angles γ with respect to the adjoining edge of the side panels 86. In the embodiment of FIG. 8, the angles γ are about 45 degrees and the side flaps 98 are triangular in shape. In some embodiments, the angles γ are between 40 degrees and 50 degrees. In some embodiments, the angles γ are acute. The side flaps 98 are connected to the side panels 86 along respective edges 100 thereof that define the height h, which height is shared between the side flaps 98 and the side panels 86. In addition to the height h, the side flaps 98 each extend a distance d2 from the edge 100 to a distal portion thereof, the distance d2 being approximately one-half the height h (i.e., d≈½ h). Finally, a pair of top flaps 102 are connected to the top panels 88 along respective edges 104 thereof that define the width w, which width is shared between the top flaps 102 and the top panels 88. In addition to the width w, the top flaps 102 each extend a distance approximately equal to the height h from the edge 104 to a distal portion thereof. In the embodiment of FIG. 8, the top flaps 102 are rectangular in shape. In some embodiments, so long as the panels 84 and 88 are sized according to the length l and the width w, the panels 86 are sized according to the length l and the height h, and the angles γ are each about 45 degrees, the packaging sheet 82 can be made to fit any size article, object, or box where the width w is approximately equal to the height h (i.e., w≈h).

Figure 9:
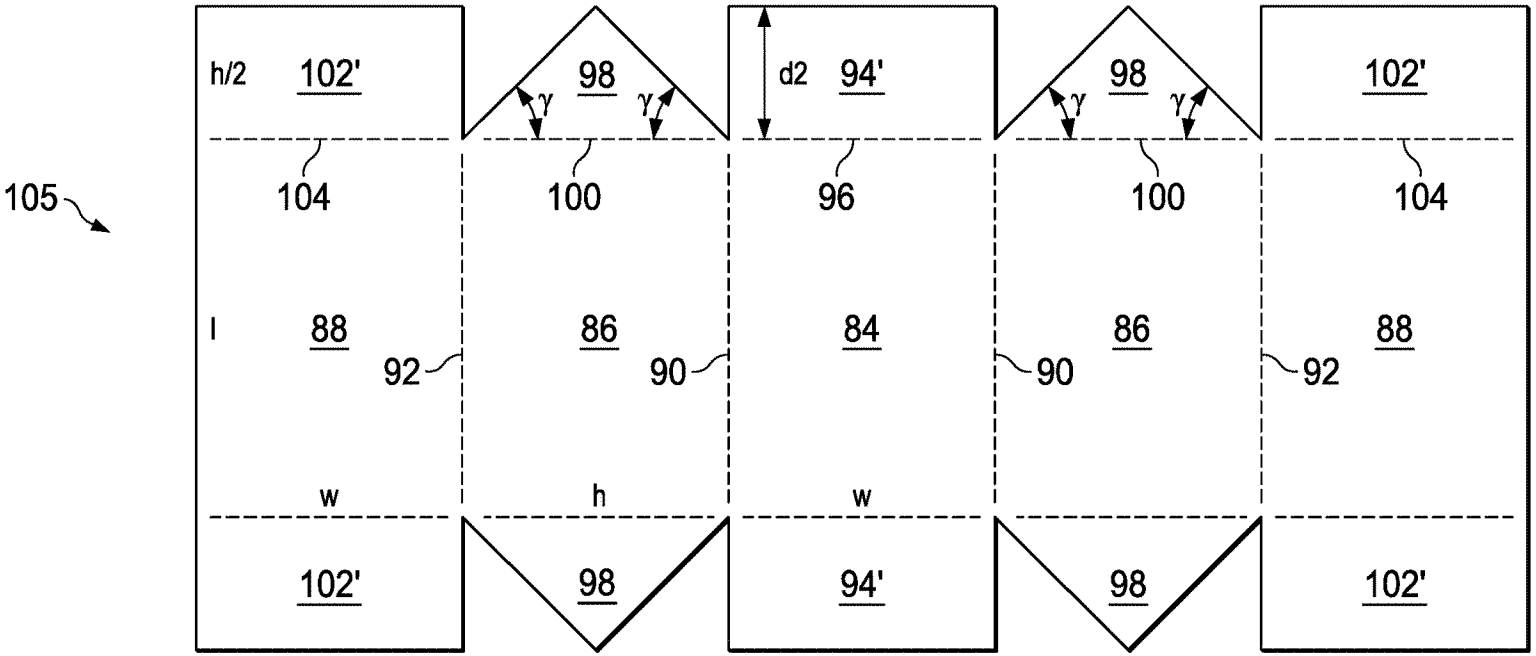
FIG. 9 is a plan view of yet another packaging sheet adapted to wrap the article or object, provide structure around the article or object, or form the box, of FIG. 1(*a*), according to one or more embodiments of the present disclosure.

In some embodiments, the bottom flaps 94 of the packaging sheet 82 are cut along respective lines B-B (shown in FIG. 8) so that the respective distal end portions of the resulting bottom flaps each define straight-cut lines and extend the distance d2 (rather than the height h) from the respective edges 96—as a result, the bottom flaps are oblong rectangular in shape (shown pre-cut in FIG. 9). In some embodiments, the top flaps 102 of the packaging sheet 82 are cut along the respective lines B-B so that the respective distal end portions of the resulting top flaps each define straight-cut lines, and extend the distance d2 (rather than the height h) from the respective edges 104—as a result, the top flaps are oblong rectangular in shape (shown pre-cut in FIG. 9). In some embodiments, the bottom flaps 94 and the top flaps 102 of the packaging sheet 82 are cut along the respective lines B-B so that the respective distal end portions of the resulting bottom flaps and top flaps each define straight-cut lines and extend the distance d2 (rather than the height h) from the respective edges 96 and 104—as a result, the bottom flaps and the top flaps are oblong rectangular in shape (shown pre-cut in FIG. 9).

In operation, in an embodiment, the packaging sheet 82 of FIG. 8 is used to wrap the article or object, provide structure around the article or object, or form the box of FIG. 1(*a*). More particularly, the side panels 86 of the packaging sheet 82 are folded along the edges 90 at right-angles relative to the bottom panel 84. In a similar manner, the top panels 88 of the packaging sheet 82 are folded along the edges 92 at right-angles relative to the respective side panels 86. As a result, the top panels 88 overlap, align, and can be detachably connected to one another, so that the packaging sheet 82 forms a generally tubular shape defining opposing end portions. The opposing end portions of the tubular shape formed by the packaging sheet 82 are enclosed by first folding the top flaps 102 along the edges 104 at right-angles relative to the respective top panels 88. Next, the bottom flaps 94 are folded along the edges 96 at right-angles relative to the bottom panel 84. Finally, the side flaps 98 are folded along the edges 100 at right-angles relative to the side panels 86, and are overlapped and detachably connected to one or more of the bottom flaps 94 and the top flaps 102. In some embodiments, the packaging sheet 82 may be used (or configured) to wrap another article or object having length, width, and height dimensions that are equal to, or less than, the length l, the width w, and the height h.

Referring to FIG. 9, yet another embodiment of a packaging sheet made to fit (or form) the article, object, or box shown in FIG. 1(*a*) is generally referred to by the reference numeral 105—however, although described herein with reference to the article, object, or box shown in FIG. 1(*a*), the dimensions of the packaging sheet 105 can be altered to fit any size article, object, or box where the width w is approximately equal to the height h (i.e., w≈h). The packaging sheet 105 includes several features that are substantially identical to corresponding features of the packaging sheet 82, which identical features are given the same reference numerals. In some embodiments of the packaging sheet 105, the bottom flaps 94 are replaced with pre-cut bottom flaps 94' whose respective distal end portions each define straight-cut lines and extend the distance d2 (rather than the height h) from the respective edges 96. As a result, the bottom flaps 94' are oblong rectangular in shape. In some embodiments of the packaging sheet 105, the top flaps 102 are replaced with pre-cut top flaps 102' whose respective distal end portions each define straight-cut lines and extend the distance d2 (rather than the height h) from the respective edges 104. As a result, the top flaps 102' are oblong rectangular in shape. In some embodiments of the packaging sheet 105 (one of which is shown in FIG. 9), the bottom flaps 94 are replaced with pre-cut bottom flaps 94' whose respective distal end portions each define straight-cut lines and extend the distance d2 (rather than the height h) from the respective edges 96, and the top flaps 102 are replaced with pre-cut top flaps 102' whose respective distal end portions each define straight-cut lines and extend the distance d2 (rather than the height h) from the respective edges 104. As a result, the bottom flaps 94' and the top flaps 102' are oblong rectangular in shape.

Figure 10:
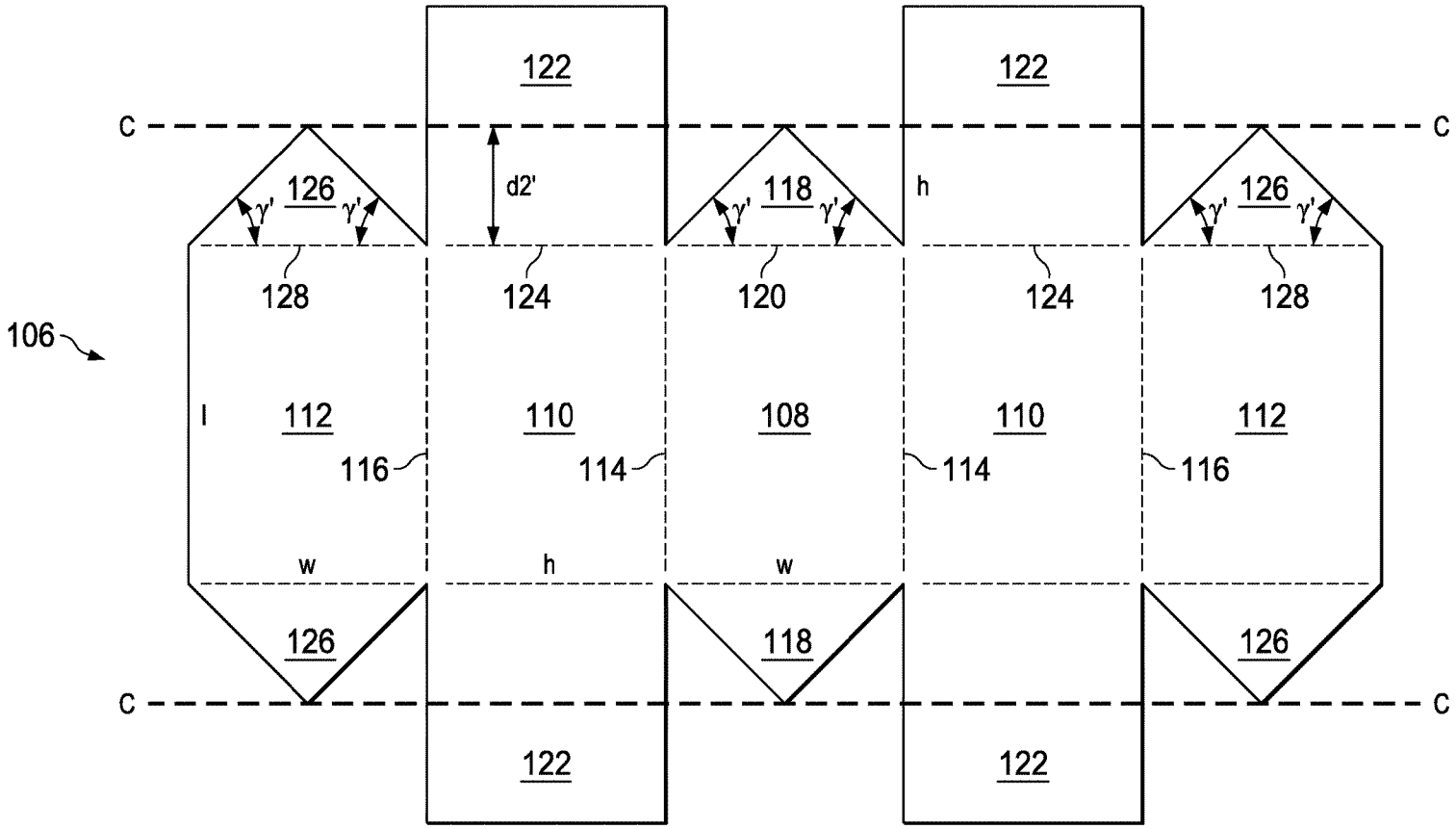
FIG. 10 is a plan view of yet another packaging sheet adapted to wrap the article or object, provide structure around the article or object, or form the box, of FIG. 1(*a*), according to one or more embodiments of the present disclosure.

Referring to FIG. 10, yet another embodiment of a packaging sheet made to fit (or form) the article, object, or box shown in FIG. 1(*a*) is generally referred to by the reference numeral 106—however, although described herein with reference to the article, object, or box shown in FIG. 1(*a*), the dimensions of the packaging sheet 106 can be altered to fit any size article, object, or box where the width w is approximately equal to the height h (i.e., w≈h). The packaging sheet 106 includes a plurality of rectangular panels connected in series with one another. More particularly, a pair of opposing side panels 110 are connected to a centrally located bottom panel 108, and a pair of top panels 112 are connected to the respective side panels 110, opposite the bottom panel 108. The bottom panel 108 and the top panels 112 are substantially identical, each defining the length l and the width w. Moreover, the side panels 110 are substantially identical, each defining the length l and the height h. The side panels 110 are connected to the bottom panel 108 along respective edges 114 thereof that define the length l. Similarly, the top panels 112 are connected to the side panels 110 along respective edges 116 thereof that define the length l. Thus, the length l is a shared dimension between the bottom panel 108, the side panels 110, and the top panels 112.

In some embodiments, a pair of bottom flaps 118 are connected to the bottom panel 108, each including a pair of outer edges extending at angles γ' with respect to the adjoining edge of the bottom panel 108. In the embodiment of FIG. 10, the angles γ' are about 45 degrees and the bottom flaps 118 are triangular in shape. In some embodiments, the angles γ' are between 40 degrees and 50 degrees. In some embodiments, the angles γ' are acute. The bottom flaps 118 are connected to the bottom panel 108 along respective edges 120 thereof that define the width w, which width w is shared between the bottom flaps 118 and the bottom panel 108. In addition to the width w, the bottom flaps 118 each extend a distance d2' from the edge 120 to a distal portion thereof, the distance d2' being approximately one-half the width w (i.e., d'≈½ w). Further, a pair of side flaps 122 are connected to the each of the side panels 110 along respective edges 124 thereof that define the height h, which height is shared between the side flaps 122 and the side panels 110. In addition to the height h, the side flaps 122 each extend a distance approximately equal to the height h from the edge 124 to a distal portion thereof. In the embodiment of FIG. 10, the side flaps 122 are rectangular in shape. Finally, a pair of top flaps 126 are connected to each of the top panels 112, each including a pair of outer edges extending at the angles γ' with respect to the adjoining edge of the top panels 112. In the embodiment of FIG. 10, the angles γ' are about 45 degrees and the top flaps 126 are triangular in shape. In some embodiments, the angles γ' are between 40 degrees and 50 degrees. In some embodiments, the angles γ' are acute. The top flaps 126 are connected to the top panels 112 along respective edges 128 thereof that define the width w, which width w is shared between the top flaps 126 and the top panels 112. In addition to the width w, the top flaps 126 each extend the distance d2' from the edge 128 to a distal portion thereof, the distance d2' being approximately one-half the width w (i.e., d'≈½ w). In some embodiments, so long as the panels 108 and 112 are sized according to the length l and the width w, the panels 110 are sized according to the length l and the height h, and the angles γ' are each about 45 degrees, the packaging sheet 106 can be made to fit any size article, object, or box where the width w is approximately equal to the height h (i.e., w≈h).

Figure 11:
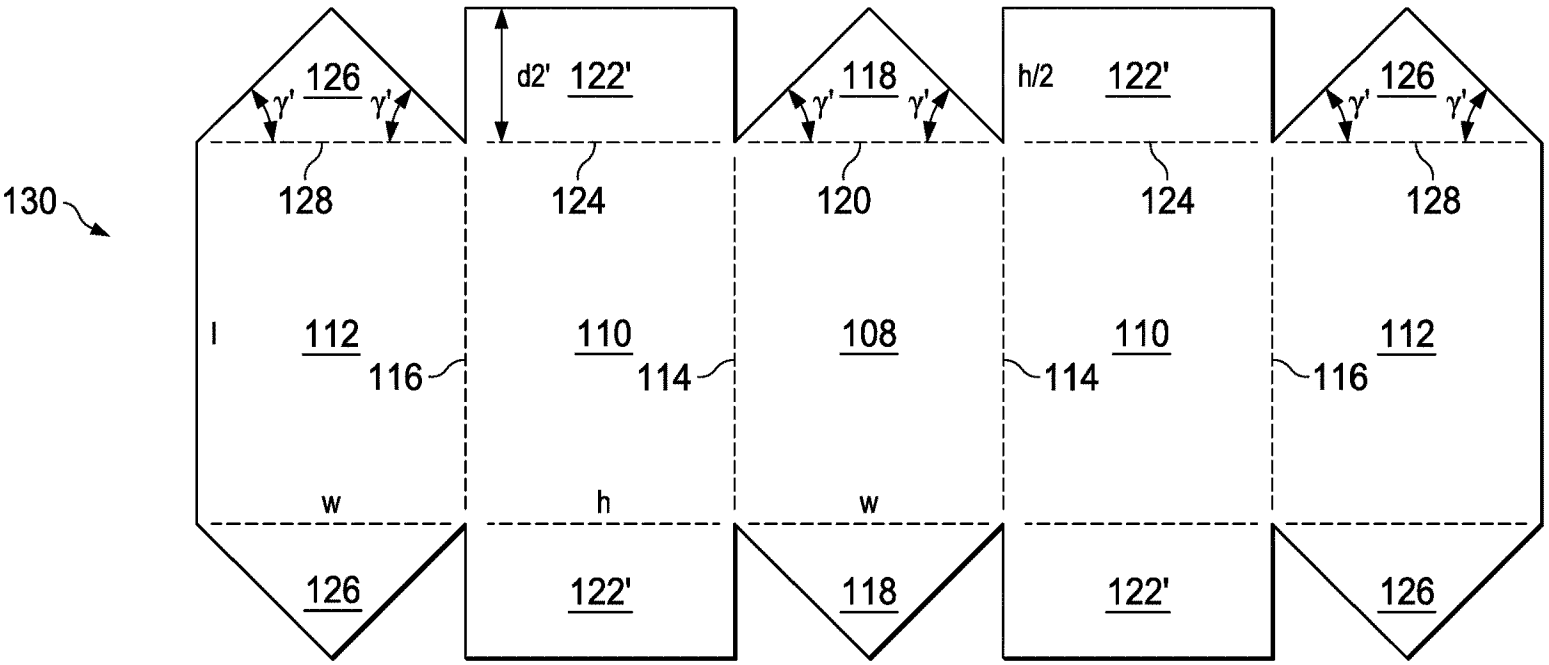
FIG. 11 is a plan view of yet another packaging sheet adapted to wrap the article or object, provide structure around the article or object, or form the box, of FIG. 1(*a*), according to one or more embodiments of the present disclosure.

In some embodiments, the side flaps 122 of the packaging sheet 106 are cut along respective lines C-C (shown in FIG. 10) so that the respective distal end portions of the resulting side flaps each define straight-cut lines and extend the distance d2' (rather than the height h) from the respective edges 124—as a result, the side flaps are oblong rectangular in shape (shown pre-cut in FIG. 11).

In operation, in an embodiment, the packaging sheet 106 of FIG. 10 is used to wrap the article or object, provide structure around the article or object, or form the box of FIG. 1(*a*). More particularly, the side panels 110 of the packaging sheet 106 are folded along the edges 114 at right-angles relative to the bottom panel 108. In a similar manner, the top panels 112 of the packaging sheet 106 are folded along the edges 116 at right-angles relative to the respective side panels 110. As a result, the top panels 112 overlap, align, and can be detachably connected to one another, so that the packaging sheet 106 forms a generally tubular shape defining opposing end portions. The opposing end portions of the tubular shape formed by the packaging sheet 106 are enclosed by first folding the side flaps 122 along the edges 124 at right-angles relative to the respective side panels 110 so that the side flaps 122 overlap one another. Next, the top flaps 126 are folded along the edges 128 at right-angles relative to the respective top panels 112. Finally, the bottom flaps 118 are folded along the edges 120 at right-angles relative to the bottom panel 108, and are overlapped and detachably connected to one or more of the side flaps 122 and the top flaps 126. In some embodiments, the packaging sheet 106 may be used (or configured) to wrap another article or object having length, width, and height dimensions that are equal to, or less than, the length l, the width w, and the height h.

Referring to FIG. 11, yet another embodiment of a packaging sheet made to fit (or form) the article, object, or box shown in FIG. 1(*a*) is generally referred to by the reference numeral 130—however, although described herein with reference to the article, object, or box shown in FIG. 1(*a*), the dimensions of the packaging sheet 130 can be altered to fit any size article, object, or box where the width w is approximately equal to the height h (i.e., w≈h). The packaging sheet 130 includes several features that are substantially identical to corresponding features of the packaging sheet 106, which identical features are given the same reference numerals. In some embodiments of the packaging sheet 130, the side flaps 122 are replaced with pre-cut side flaps 122' whose respective distal end portions each define straight-cut lines and extend the distance d2' (rather than the height h) from the respective edges 124. As a result, the side flaps 122' are oblong rectangular in shape.

Figure 12:
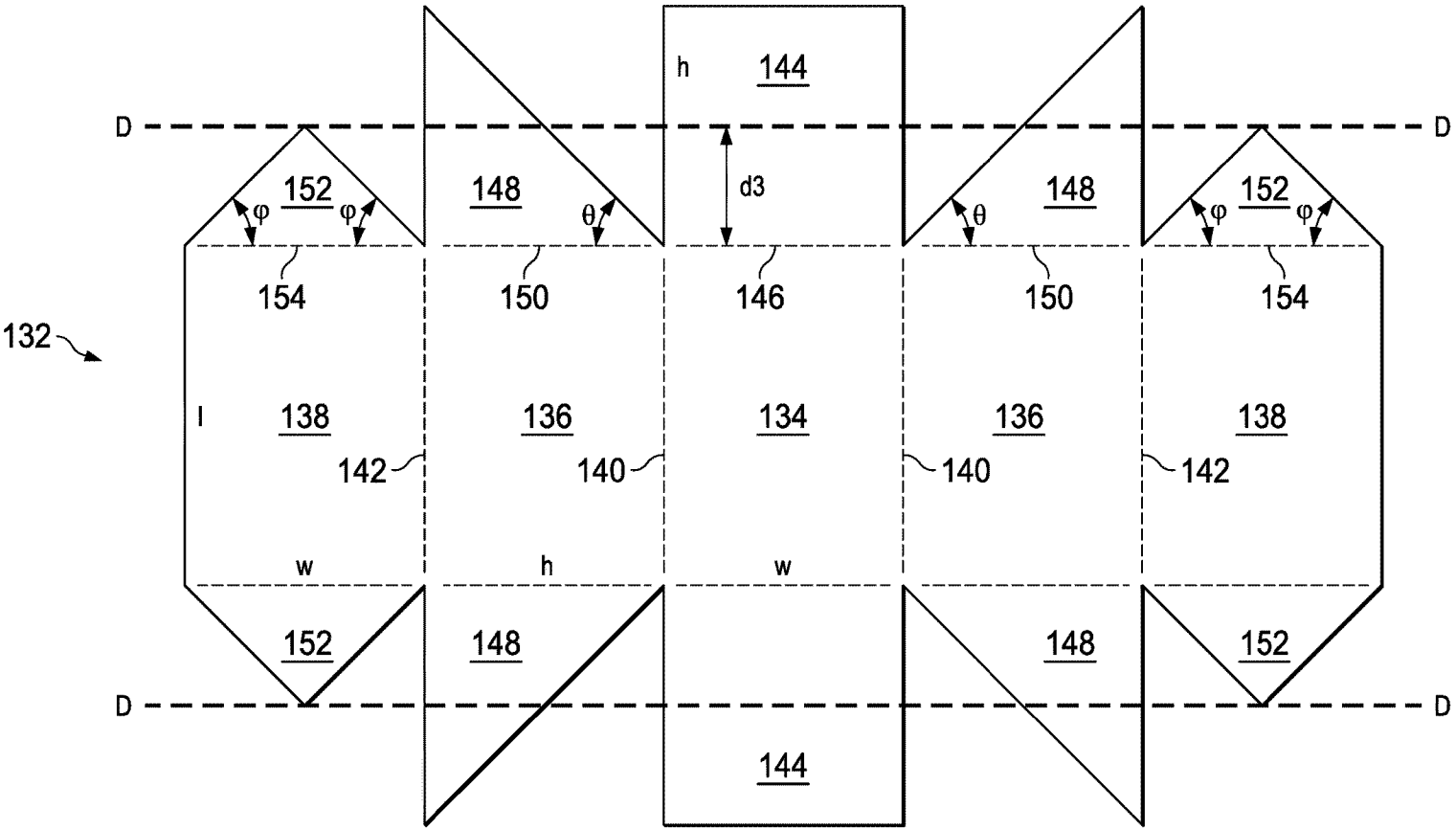
FIG. 12 is a plan view of yet another packaging sheet adapted to wrap the article or object, provide structure around the article or object, or form the box, of FIG. 1(*a*), according to one or more embodiments of the present disclosure.
Figure 13C:
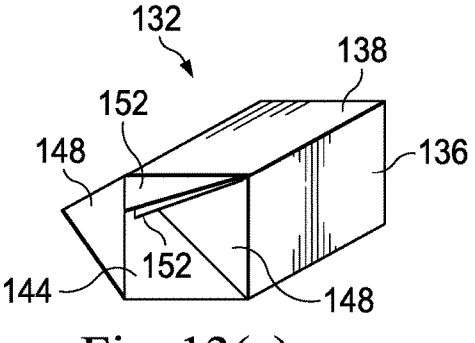
FIGS. 13(*a*)-(*f*) are perspective view of the packaging sheet of FIG. 12 in first, second, third, fourth, fifth, and sixth stages of construction, respectively, to wrap the article or object, provide structure around the article or object, or form the box, of FIG. 1(*a*), according to one or more embodiments of the present disclosure.
Figure 13B:
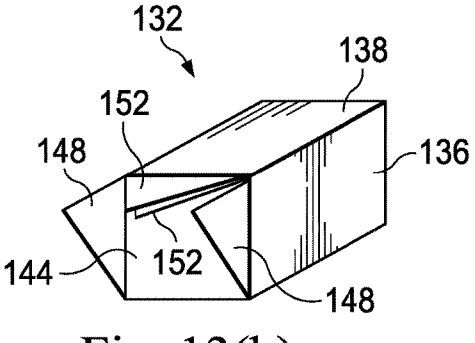
Figure 13A:
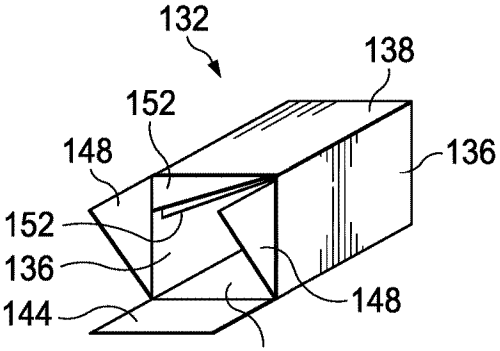
Figure 13F:
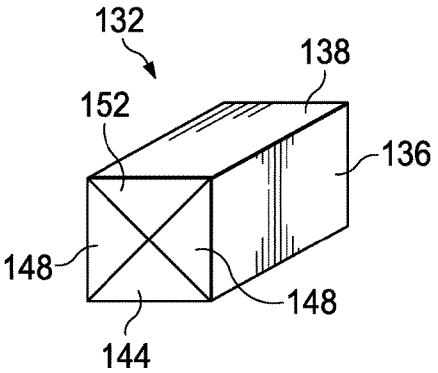
Figure 13E:
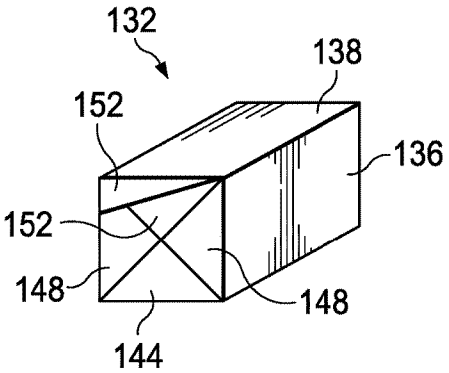
Figure 13D:
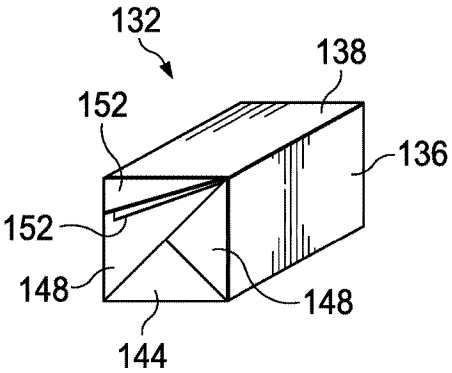

Referring to FIGS. 12 and 13(*a*)-(*f*), yet another embodiment of a packaging sheet made to fit (or form) the article, object, or box shown in FIG. 1(*a*) is generally referred to by the reference numeral 132—however, although described herein with reference to the article, object, or box shown in FIG. 1(*a*), the dimensions of the packaging sheet 132 can be altered to fit any size article, object, or box where the width w is approximately equal to the height h (i.e., w≈h). The packaging sheet 132 includes a plurality of rectangular panels connected in series with one another. More particularly, a pair of opposing side panels 136 are connected to a centrally located bottom panel 134 and a pair of top panels 138 are connected to the respective side panels 136, opposite the bottom panel 134. The bottom panel 134 and the top panels 138 are substantially identical, each defining the length l and the width w. Moreover, the side panels 136 are substantially identical, each defining the length l and the height h. The side panels 136 are connected to the bottom panel 134 along respective edges 140 thereof that define the length l. Similarly, the top panels 138 are connected to the side panels 136 along respective edges 142 thereof that define the length l. Thus, the length l is a shared dimension between the bottom panel 134, the side panels 136, and the top panels 138.

In some embodiments, a pair of bottom flaps 144 are connected to the bottom panel 134 along respective edges 146 thereof that define the width w, which width is shared between the bottom flaps 144 and the bottom panel 134. In addition to the width w, the bottom flaps 144 each extend a distance approximately equal to the height h from the edge 146 to a distal portion thereof. In the embodiment of FIG. 12, the bottom flaps 144 are rectangular in shape. Further, a pair of side flaps 148 are connected to each of the side panels 136, each including a long edge extending at an angle Θ with respect to the adjoining edge of the side panel 136, and a short edge extending at a 90-degree angle with respect to the adjoining edge of the side panel 136. In the embodiment of FIG. 12, the angles Θ are about 45 degrees and the side flaps 148 are triangular in shape. In some embodiments, the angles Θ are between 40 degrees and 50 degrees. In some embodiments, the angles Θ are acute. In some embodiments, the respective corners of the side flaps 148 defining the angles Θ are positioned adjacent the respective edges 140 between the bottom panel 134 and the side panels 136 and opposite respective corners of the bottom panel 134. In some embodiments, the respective short edges of the side flaps 148 extending at the 90-degree angles with respect to the adjoining edges of the side panels 136 (i.e., the short edges opposite the respective corners of the side flaps 148 defining the angles Θ) are substantially co-planar (or aligned) with the respective edges 142 between the side panels 136 and the top panels 138 when the packaging sheet 132 wraps the article or object, provides structure around the article or object, or forms the box. The side flaps 148 are connected to the respective side panels 136 along respective edges 150 thereof that define the height h, which height is shared between the side flaps 148 and the side panels 136. In addition to the height h, the side flaps 148 each extend a distance approximately equal to the height h from the edge 150 to a distal portion thereof.

Finally, a pair of top flaps 152 are connected to each of the top panels 138—the top flaps 152 each include a pair of outer edges extending at angles φ with respect to the respective adjoining edges of the top panels 138. In the embodiment of FIG. 12, the angles φ are about 45 degrees and the top flaps 152 are triangular in shape. In some embodiments, the angles φ are between 40 degrees and 50 degrees. In some embodiments, the angles φ are acute. The top flaps 152 are connected to the top panels 138 along respective edges 154 thereof that define the width w, which width is shared between the top flaps 152 and the top panels 138. In addition to the width w, the top flaps 152 each extend a distance d3 from the edge 154 to a distal portion thereof, the distance d3 being the lesser of: one-half the width w; and the height h. In some embodiments, so long as the panels 134 and 138 are sized according to the length l and the width w, the panels 136 are sized according to the length l and the height h, and the angles Θ and φ are each about 45 degrees, the packaging sheet 132 can be made to fit any size article, object, or box where the width w is approximately equal to the height h (i.e., w≈h).

In some embodiments, the bottom flaps 144 of the packaging sheet 132 are cut along respective lines D-D (shown in FIG. 12) so that the respective distal end portions of the resulting bottom flaps each define straight-cut lines, and extend the distance d3 (rather than the height h) from the respective edges 146—as a result, the bottom flaps are oblong rectangular in shape (shown pre-cut in FIG. 13). In some embodiments, the side flaps 148 of the packaging sheet 132 are cut along the respective lines D-D so that the respective distal end portions of the resulting side flaps each define straight-cut lines (rather than points) and extend the distance d3 (rather than the height h) from the respective edges 150—as a result, the side flaps are trapezoidal in shape (shown pre-cut in FIG. 13). In some embodiments, the bottom flaps 144 and the side flaps 148 of the packaging sheet 132 are cut along the respective lines D-D so that the respective distal end portions of the resulting bottom flaps and side flaps each define straight-cut lines and extend the distance d3 (rather than the height h) from the respective edges 146 and 150—as a result, the bottom flaps are oblong rectangular in shape and the side flaps are trapezoidal in shape (shown pre-cut in FIG. 13).

Turning to FIGS. 13(*a*)-(*f*), in operation, the packaging sheet 132 of FIG. 12 is used to wrap the article or object, provide structure around the article or object, or form the box of FIG. 1(*a*). More particularly, the side panels 136 of the packaging sheet 132 are folded along the edges 140 at right-angles relative to the bottom panel 134. In a similar manner, the top panels 138 of the packaging sheet 132 are folded along the edges 142 at right-angles relative to the respective side panels 136. As a result, the top panels 138 overlap, align, and can be detachably connected to one another, so that the packaging sheet 132 forms a generally tubular shape defining opposing end portions. The packaging sheet 132 is illustrated in FIG. 13(*a*) forming the generally tubular shape with one of the opposing end portions thereof being enclosed by the corresponding bottom flap 144, side flaps 148, and top flaps 152. FIG. 13(*b*) illustrates the other end portion of the tubular shape formed by the packaging sheet 132 being enclosed by first folding the bottom flap 144 along the edge 146 at a right-angle relative to the bottom panel 134. Next, as shown in FIGS. 13(*c*) and (*d*), the side flaps 148 are folded along the edges 150 at right-angles relative to the side panels 136 so that the side flaps 148 overlap the bottom flap 144 and one another. As a result, the respective short edges of the side flaps 148 extending at the 90-degree angles with respect to the adjoining edges of the side panels 136 (i.e., the short edges opposite the respective corners of the side flaps 148 defining the angles Θ) extend along the respective edges 154 between the top panels 138 and the top flaps 152. Finally, as shown in FIGS. 13(*e*) and (*f*), the top flaps 152 are folded one after the other along the edges 154 at right-angles relative to the top panels 138 so that one of the top flaps 152 overlies the other of the top flaps 152—at least the overlying top flap 152 is then detachably connected to one or more of the side flaps 148 and the bottom flap 144. In some embodiments, the packaging sheet 132 may be used (or configured) to wrap another article or object having length, width, and height dimensions that are equal to, or less than, the length l, the width w, and the height h.

Figure 14:
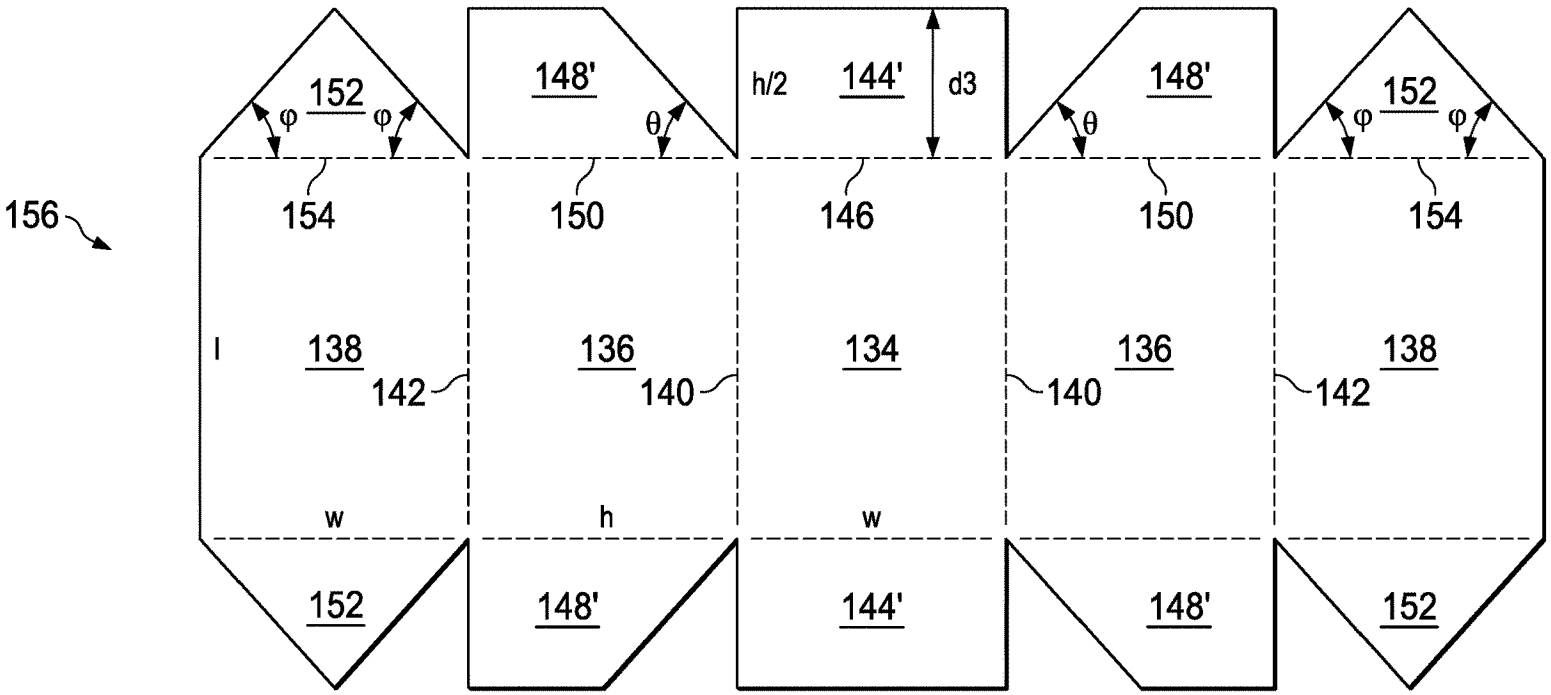
FIG. 14 is a plan view of yet another packaging sheet adapted to wrap the article or object, provide structure around the article or object, or form the box, of FIG. 1(*a*), according to one or more embodiments of the present disclosure.

Referring to FIG. 14, another embodiment of a packaging sheet made to fit (or form) the article, object, or box shown in FIG. 1(*a*) is generally referred to by the reference numeral 156—however, although described herein with reference to the article, object, or box shown in FIG. 1(*a*), the dimensions of the packaging sheet 156 can be altered to fit any size article, object, or box where the width w is approximately equal to the height h (i.e., w≈h). The packaging sheet 156 includes several features that are substantially identical to corresponding features of the packaging sheet 132, which identical features are given the same reference numerals. In some embodiments of the packaging sheet 156, the bottom flaps 144 are replaced with pre-cut bottom flaps 144' whose respective distal end portions each define straight-cut lines and extend the distance d3 (rather than the height h) from the respective edges 146. As a result, the bottom flaps 144' are oblong rectangular in shape. In some embodiments of the packaging sheet 156, the side flaps 148 are replaced with pre-cut side flaps 148' whose respective distal end portions each define straight-cut lines (rather than points) and extend the distance d3 (rather than the height h) from the respective edges 150. As a result, the side flaps 148' are trapezoidal in shape. In some embodiments of the packaging sheet 156 (one of which is shown in FIG. 14), the bottom flaps 144 are replaced with the pre-cut bottom flaps 144' whose respective distal end portions each define straight-cut lines and extend the distance d3 (rather than the height h) from the respective edges 146, and the side flaps 148 are replaced with the pre-cut side flaps 148' whose respective distal end portions each define straight-cut lines (rather than points) and extend the distance d3 (rather than the height h) from the respective edges 150. As a result, the bottom flaps 144' are oblong rectangular in shape and the side flaps 148' are trapezoidal in shape.

Figure 15:
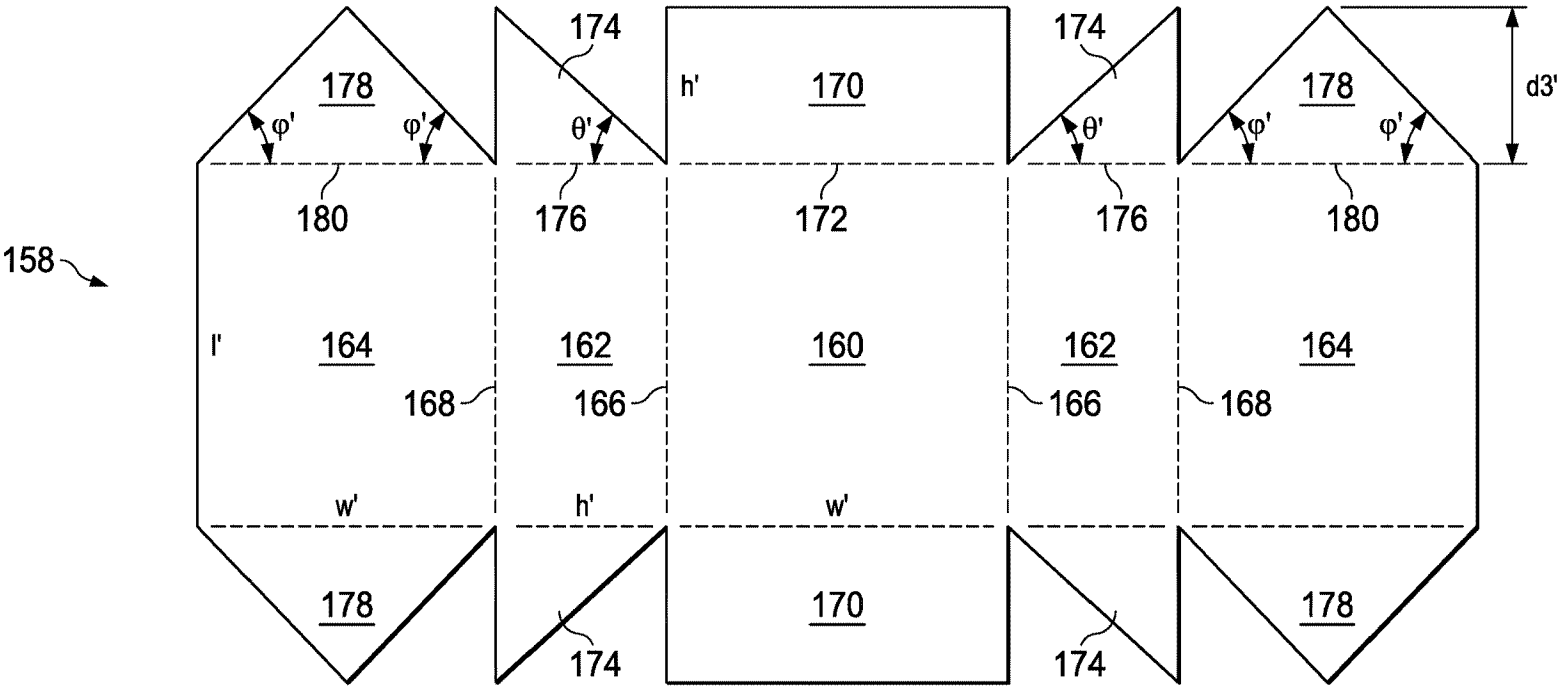
FIG. 15 is a plan view of another packaging sheet adapted to wrap the article or object, provide structure around the article or object, or form the box, of FIG. 1(*b*), according to one or more embodiments of the present disclosure.

Referring to FIG. 15, another embodiment of a packaging sheet made to fit (or form) the article, object, or box shown in FIG. 1(*b*) is generally referred to by the reference numeral 158—however, although described herein with reference to the article, object, or box shown in FIG. 1(*b*), the dimensions of the packaging sheet 158 can be altered to fit any size article, object, or box where the width w' is approximately two-times the height h' (i.e., $w' \approx 2h'$). Moreover, the dimensions of the packaging sheet 158 can be altered to fit any size article, object, or box where the width w' is greater than the height h' and less than (or equal to) two-times the height h' (i.e., $h' < w' \leq 2h'$)—such a packaging sheet may end up looking different than the packaging sheet 158, but the methodology to make the systematic or mathematical pattern is the same. The packaging sheet 158 includes a plurality of rectangular panels connected in series with one another. More particularly, a pair of opposing side panels 162 are connected to a centrally located bottom panel 160, and a pair of top panels 164 are connected to the respective side panels 162, opposite the bottom panel 160. The bottom panel 160 and the top panels 164 are substantially identical, each defining the length l' and the width w'. Moreover, the side panels 162 are substantially identical, each defining the length l' and the height h'. The side panels 162 are connected to the bottom panel 160 along respective edges 166 thereof that define the length l'. Similarly, the top panels 164 are connected to the side panels 162 along respective edges 168 thereof that define the length l'. Thus, the length l' is a shared dimension between the bottom panel 160, the side panels 162, and the top panels 164.

In some embodiments, a pair of bottom flaps 170 are connected to the bottom panel 160 along respective edges 172 thereof that define the width w', which width is shared between the bottom flaps 170 and the bottom panel 160. In addition to the width w', the bottom flaps 170 each extend a distance approximately equal to the height h' from the edge 172 to a distal portion thereof. In the embodiment of FIG. 15, the bottom flaps 170 are oblong rectangular in shape. Further, a pair of side flaps 174 are connected to each of the side panels 162, each including a long edge extending at an angle Θ' with respect to the adjoining edge of the side panel 162, and a short edge extending at a 90-degree angle with respect to the adjoining edge of the side panel 162. In the embodiment of FIG. 15, the angles Θ' are about 45 degrees and the side flaps 174 are triangular in shape. In some embodiments, the angles Θ' are between 40 degrees and 50 degrees. In some embodiments, the angles Θ' are acute. In some embodiments, the respective corners of the side flaps 174 defining the angles Θ' are positioned adjacent the respective edges 166 between the bottom panel 160 and the side panels 162 and opposite respective corners of the bottom panel 160. In some embodiments, the respective short edges of the side flaps 174 extending at the 90-degree angles with respect to the adjoining edges of the side panels 162 (i.e., the short edges opposite the respective corners of the side flaps 174 defining the angles Θ') are substantially co-planar (or aligned) with the respective edges 168 between the side panels 162 and the top panels 164 when the packaging sheet 158 wraps the article or object, provides structure around the article or object, or forms the box. The side flaps 174 are connected to the respective side panels 162 along respective edges 176 thereof that define the height h', which height is shared between the side flaps 174 and the side panels 162. In addition to the height h', the side flaps 174 each extend a distance approximately equal to the height h' from the edge 176 to a distal portion thereof.

Finally, a pair of top flaps 178 are connected to each of the top panels 164—the top flaps 178 each include a pair of outer edges extending at angles φ' with respect to the respective adjoining edges of the top panels 164. In the embodiment of FIG. 15, the angles φ' are about 45 degrees and the top flaps 178 are triangular in shape. In some embodiments, the angles φ' are between 40 degrees and 50 degrees. In some embodiments, the angles φ' are acute. The top flaps 178 are connected to the top panels 164 along respective edges 180 thereof that define the width w', which width is shared between the top flaps 178 and the top panels 164. In addition to the width w', the top flaps 178 each extend a distance d3' from the edge 180 to a distal portion thereof, the distance d3' being the lesser of: one-half the width w'; and the height h'. In some embodiments, so long as the panels 160 and 164 are sized according to the length l' and the width w', the panels 162 are sized according to the length l' and the height h', and the angles Θ' and φ' are each about 45 degrees, the packaging sheet 158 can be made to fit any size article, object, or box where the width w' is greater than the height h' and less than two-times the height h' (i.e., $h' < w' < 2h'$).

In operation, in an embodiment, the packaging sheet 158 is used to wrap an article or object, provide structure around the article or object, or form a box defining the length l', the width w', and the height h' in a manner similar to the manner in which the packaging sheet 132 is used to wrap the article or object, provide structure around the article or object, or form the box defining the length l, the width w, and the height h—therefore, the operation of the packaging sheet 158 will not be discussed in further detail. In some embodiments, the packaging sheet 158 may be used (or configured) to wrap another article or object having length, width, and height dimensions that are equal to, or less than, the length l', the width w', and the height h'.

Figure 16:
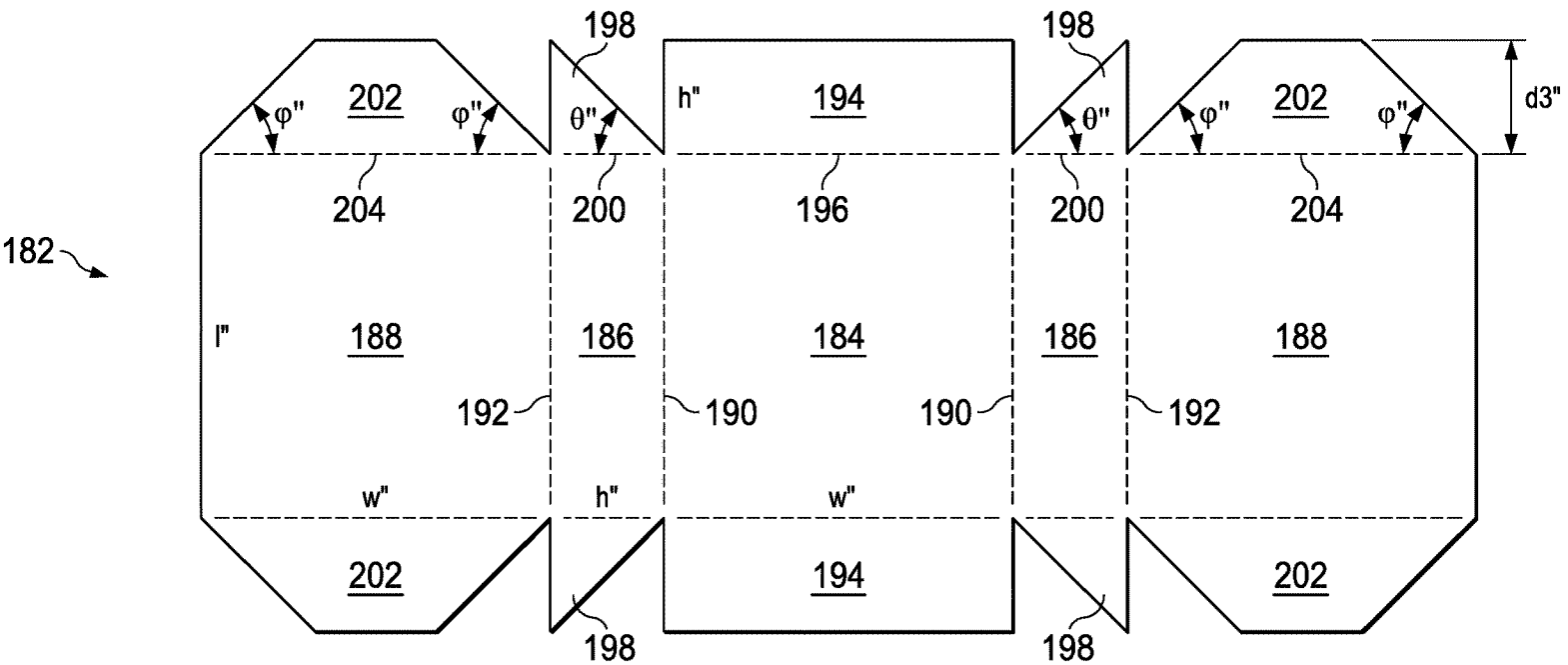
FIG. 16 is a plan view of another packaging sheet adapted to wrap the article or object, provide structure around the article or object, or form the box, of FIG. 1(*c*), according to one or more embodiments of the present disclosure.

Referring to FIG. 16, another embodiment of a packaging sheet made to fit (or form) the article, object, or box shown in FIG. 1(*c*) is generally referred to by the reference numeral 182—however, although described herein with reference to the article, object, or box shown in FIG. 1(*c*), the dimensions of the packaging sheet 182 can be altered to fit any size article, object, or box where the width w" is approximately three-times the height h" (i.e., $w'' \approx 3h''$). Moreover, the dimensions of the packaging sheet 182 can be altered to fit any size article, object, or box where the width w" is greater than two-times the height h" (i.e., $w'' > 2h''$)—such a packaging sheet may end up looking different than the packaging sheet 182, but the methodology to make the systematic or mathematical pattern is the same. The packaging sheet 182 includes a plurality of rectangular panels connected in series with one another. More particularly, a pair of opposing side panels 186 are connected to a centrally located bottom panel 184, and a pair of top panels 188 are connected to the respective side panels 186, opposite the bottom panel 184. The bottom panel 184 and the top panels 188 are substantially identical, each defining the length l" and the width w". Moreover, the side panels 186 are substantially identical, each defining the length l" and the height h". The side panels 186 are connected to the bottom panel 184 along respective edges 190 thereof that define the length l". Similarly, the top panels 188 are connected to the side panels 186 along respective edges 192 thereof that define the length l". Thus, the length l" is a shared dimension between the bottom panel 184, the side panels 186, and the top panels 188.

In some embodiments, a pair of bottom flaps 194 are connected to the bottom panel 184 along respective edges 196 thereof that define the width w", which width is shared between the bottom flaps 194 and the bottom panel 184. In addition to the width w", the bottom flaps 194 each extend a distance approximately equal to the height h" from the edge 196 to a distal portion thereof. In the embodiment of FIG. 16, the bottom flaps 194 are oblong rectangular in shape. Further, a pair of side flaps 198 are connected to each of the side panels 186, each including a long edge extending at an angle Θ" with respect to the adjoining edge of the side panel 186, and a short edge extending at a 90-degree angle with respect to the adjoining edge of the side panel 186. In the embodiment of FIG. 16, the angles Θ" are about 45 degrees and the side flaps 198 are triangular in shape. In some embodiments, the angles Θ" are between 40 degrees and 50 degrees. In some embodiments, the angles Θ" are acute. In some embodiments, the respective corners of the side flaps 198 defining the angles Θ" are positioned adjacent the respective edges 190 between the bottom panel 184 and the side panels 186 and opposite respective corners of the bottom panel 184. In some embodiments, the respective short edges of the side flaps 198 extending at the 90-degree angles with respect to the adjoining edges of the side panels 186 (i.e., the short edges opposite the respective corners of the side flaps 198 defining the angles Θ" are substantially co-planar (or aligned) with the respective edges 192 between the side panels 186 and the top panels 188 when the packaging sheet 182 wraps the article or object, provides structure around the article or object, or forms the box. The side flaps 198 are connected to the respective side panels 186 along respective edges 200 thereof that define the height h", which height is shared between the side flaps 198 and the side panels 186. In addition to the height h", the side flaps 198 each extend a distance approximately equal to the height h" from the edge 200 to a distal portion thereof.

Finally, a pair of top flaps 202 are connected to each of the top panels 188—the top flaps 202 each include a pair of outer edges extending at angles φ" with respect to the respective adjoining edges of the top panels 188. In the embodiment of FIG. 16, the angles φ" are about 45 degrees and the top flaps 202 are trapezoidal in shape. In some embodiments, the angles φ" are between 40 degrees and 50 degrees. In some embodiments, the angles φ" are acute. The top flaps 202 are connected to the top panels 188 along respective edges 204 thereof that define the width w", which width is shared between the top flaps 202 and the top panels 188. In addition to the width w", the top flaps 202 each extend a distance d3" from the edge 204 to a distal portion thereof, the distance d3" being the lesser of: one-half the width w"; and the height h". In those embodiments where the width w" is approximately three-times the height h" (i.e., w"≈3 h"), the distance d3" is approximately equal to the height h" (i.e., x"≈h"). Additionally, since the width w" is greater than two-times the height h" (i.e., w">2 h"), the respective distal end portions of the bottom flaps 194 define straight-cut lines, rather than points. In some embodiments, so long as the panels 184 and 188 are sized according to the length l" and the width w", the panels 186 are sized according to the length l" and the height h", and the angles Θ" and φ" are each about 45 degrees, the packaging sheet 182 can be made to fit any size article, object, or box where the width w" is greater than two-times the height h" (i.e., w">2 h").

In operation, in an embodiment, the packaging sheet 182 is used to wrap an article or object, provide structure around the article or object, or form a box defining the length l", the width w", and the height h" in a manner similar to the manner in which the packaging sheet 132 is used to wrap the article or object, provide structure around the article or object, or form the box defining the length l, the width w, and the height h—therefore, the operation of the packaging sheet 182 will not be discussed in further detail. In some embodiments, the packaging sheet 182 may be used (or configured) to wrap another article or object having length, width, and height dimensions that are equal to, or less than, the length l", the width w", and the height h".

Figure 17:
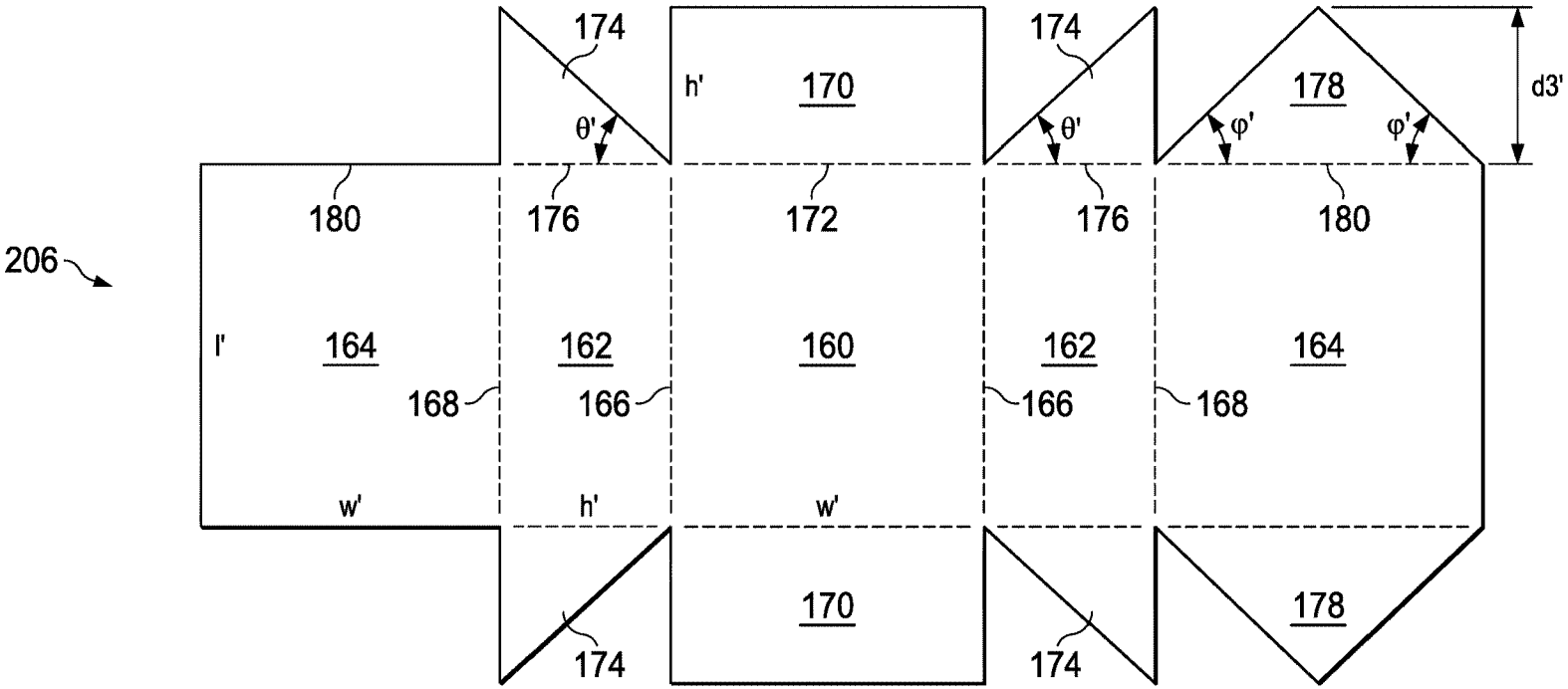
FIG. 17 is a plan view of yet another packaging sheet adapted to wrap the article or object, provide structure around the article or object, or form the box, of FIG. 1(*b*), according to one or more embodiments of the present disclosure.
Figure 18A:
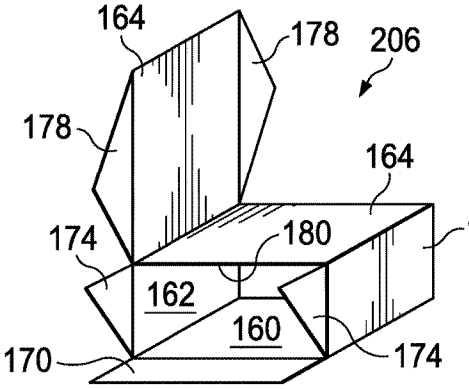
FIGS. 18(*a*)-(*f*) are perspective view of the packaging sheet of FIG. 17 in first, second, third, fourth, fifth, and sixth stages of construction, respectively, to wrap the article or object, provide structure around the article or object, or form the box, of FIG. 1(*b*), according to one or more embodiments of the present disclosure.
Figure 18B:
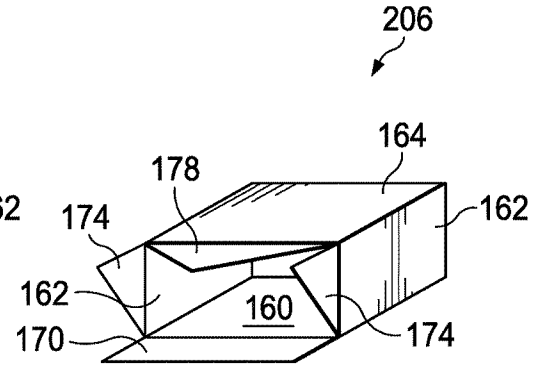
Figure 18C:
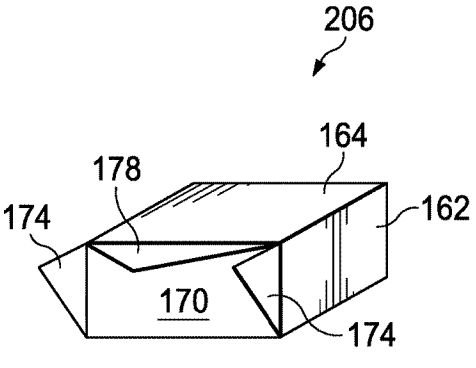
Figure 18D:
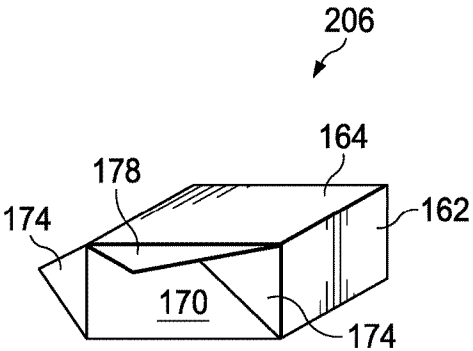
Figure 18E:
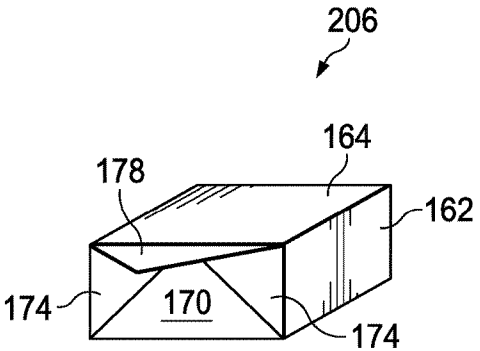
Figure 18F:
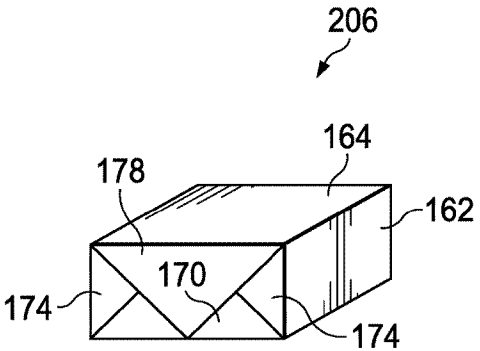

Referring to FIG. 17, yet another embodiment of a packaging sheet made to fit (or form) the article, object, or box shown in FIG. 1(*b*) is generally referred to by the reference numeral 206—however, although described herein with reference to the article, object, or box shown in FIG. 1(*b*), the dimensions of the packaging sheet 206 can be altered to fit any size article, object, or box where the width w' is approximately two-times the height h' (i.e., w'≈2 h'). Moreover, the dimensions of the packaging sheet 206 can be altered to fit any size article, object, or box where the width w' is greater than the height h' and less than (or equal to) two-times the height h' (i.e., h'<w'≤2 h')—such a packaging sheet may end up looking different than the packaging sheet 206, but the methodology to make the systematic or mathematical pattern is the same. The packaging sheet 206 is substantially identical to the packaging sheet 158, except that the packaging sheet 206 does not include top flaps (e.g., 178) connected to one of the top panels 164—therefore, in connection with FIG. 17, parts and features of the packaging sheet 206 that are substantially identical to corresponding parts and features of the packaging sheet 158 are given the same reference numerals. Thus, the packaging sheet 206 includes the bottom panel 160, the side panels 162, the top panels 164, the bottom flaps 170, and the side flaps 174, as described above in connection with FIG. 15. However, one pair of the top flaps 178 is omitted from the packaging sheet 206 and the remaining pair of the top flaps 178 is connected to one of the top panels 164 (i.e., the right-most top panel 164 as viewed in FIG. 17)—the other one of the top panels 164 to which the top flaps 178 are not connected (i.e., the left-most top panel 164 as viewed in FIG. 17) terminates along the edges 180. In some embodiments, the sole component of the packaging sheet 206 to which the top panel 164 (to which the pair of top flaps 178 is not connected) is adjoined is the adjacent side panel 162. In some embodiments, the edges 180 are substantially co-planar with the edges 172 and 176 when the packaging sheet 206 wraps the article or object, provides structure around the article or object, or forms the box.

In some embodiments, so long as the panels 160 and 164 are sized according to the length l' and the width w', the panels 162 are sized according to the length l' and the height h', and the angles Θ' and φ' are each about 45 degrees, the packaging sheet 206 can be made to fit any size article, object, or box where the width w' is greater than the height h' and less than two-times the height h' (i.e., h'<w'<2 h').

Turning to FIGS. 18(*a*)-(*f*), in operation, the packaging sheet 206 of FIG. 17 is used to wrap the article or object, provide structure around the article or object, or form the box of FIG. 1(*b*). More particularly, the side panels 162 of the packaging sheet 206 are folded along the edges 166 at right-angles relative to the bottom panel 160. In a similar manner, the top panels 164 of the packaging sheet 206 are folded along the edges 168 at right-angles relative to the respective side panels 162. As a result, the top panels 164 overlap, align, and can be detachably connected to one another, so that the packaging sheet 206 forms a generally tubular shape defining opposing end portions. More particularly, in the embodiment of FIGS. 18(*a*)-(*f*), the one of the top panels 164 to which the pair of tops flaps 178 is connected overlies the other one of the tops panels 164 to which the pair of top flaps 178 is not connected.

FIG. 18(*a*) illustrates the top panel 164 to which the pair of top flaps 178 is not connected folded along the edge 168 relative to the adjacent side panel 162 while the top panel 164 to which the pair of tops flaps 178 is connected remains unfolded. As a result, the terminal edges 180 of the top flap 164 to which the pair of top flaps 178 is not connected are substantially co-planar with the edges 172 and 176. The packaging sheet 206 is illustrated in FIG. 18(*b*) with the top panel 164 to which the pair of tops flaps 178 is connected folded along the edge 168 relative to the adjacent side panel 162 so as to form the generally tubular shape with one of the opposing end portions thereof being enclosed by the corresponding bottom flap 170, side flaps 174, and top flaps 178. FIG. 18(*c*) illustrates the other end portion of the tubular shape formed by the packaging sheet 206 being enclosed by first folding the bottom flap 170 along the edge 172 at a right-angle relative to the bottom panel 160. Next, as shown in FIGS. 18(*d*) and (*e*), the side flaps 174 are folded along the edges 176 at right-angles relative to the side panels 162 so that the side flaps 174 overlap the bottom flap 170. As a result, the respective short edges of the side flaps 174 extending at the 90-degree angles with respect to the adjoining edges of the side panels 162 (i.e., the short edges opposite the respective corners of the side flaps 174 defining the angles Θ') extend along at least the terminating edge 180 of the top panel 164 to which the pair of top flaps 178 is not connected. Finally, as shown in FIG. 18(*f*), the top flap 178 is folded along the non-terminating edge 180 at a right-angle relative to the top panel 164 to which the pair of top flaps 178 is connected (and over the terminating edge 180 of the top panel 164 to which the pair of top flaps 178 is not connected)—the top flap 178 is then detachably connected to one or more of the side flaps 174 and/or the bottom flap 170. In some embodiments, the packaging sheet 206 may be used (or configured) to wrap another article or object having length, width, and height dimensions that are equal to, or less than, the length l', the width w', and the height h'.

Instead of being connected to only one of the top panels 164, the pair of top flaps 178 may instead be split up so that one of the top flaps 178 is connected to one of the top panels 164 and the other of the top flaps 178 is connected to the other of the top panels 164. Moreover, in addition to, or instead of, the packaging sheet 206 being formed with only a single pair of the top flaps 178, the packaging sheets 10, 37, 38, 60, 82, 105, 106, 130, 132, 156, 158, and/or 182 may also be formed with only a single pair of top flaps (e.g., connected to one or both of the corresponding top panels).

In some embodiments, to reduce tearing and/or crumpling, one or more of the packaging sheets 37, 38, 60, 82, 105, 106, 130, 132, 156, 158, 182, and 206 are laminated in a manner similar to the manner in which the packaging sheet 10 is laminated-therefore, the lamination of the packaging sheet 37, 38, 60, 82, 105, 106, 130, 132, 156, 158, 182, or 206 will not be discussed in further detail. As a result, after the packaging sheet 37, 38, 60, 82, 105, 106, 130, 132, 156, 158, 182, or 206 has been used to package a gift and the gift has been unwrapped or taken out of the box, the packaging sheet 37, 38, 60, 82, 105, 106, 130, 132, 156, 158, 182, or 206 can be reused to package another gift.

In some embodiments, a cutout pattern or design (not shown), such as, for example, a die-cut pattern or design, is formed at least one of the top panels (e.g., 44, 66, 88, 112, 138, 164, or 188) in a manner similar to that described above in connection with the top panels 16—in one such embodiment, the cutout pattern or design is formed in one of the top panels so that the top panel in which the cutout pattern or design is formed overlies the other top panel when the packaging sheet wraps the article or object, provides structure around the article or object, or forms the box. As a result, the underlying top panel is exposed, and thus visible, through the cutout pattern or design in the overlying top panel. In addition, or instead, a cutout pattern or design (not shown), such as, for example, a die-cut pattern or design, may be formed in the bottom panel (e.g., 12, 40, 62, 84, 108, 134, 160, or 184) and/or at least one of the side panels (e.g., 14, 42, 64, 86, 110, 136, 162, or 186) in a manner similar to that described above with respect to the bottom panel 12 and the side panels 14. In some embodiments, colorful paper (or artwork) underlies at least one of the panels (e.g., the bottom panel, the side panels, or the top panels) in which the cutout pattern or design is formed so as to be exposed, and thus visible, through the cutout pattern or design.

The present disclosure introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third and fourth panels, respectively, the second and third flaps each defining either a first triangular shape or a first trapezoidal shape; wherein the fourth and fifth panels are spaced in a substantially parallel relation from the first panel when the packaging sheet wraps the article or object, provides structure around the article or object, or forms the box. In some embodiments, a first edge is defined between the third and fifth panels so that the fifth panel is adjoined to the third panel along the first edge; and wherein the fifth panel defines second and third edges along which no flaps are adjoined. In some embodiments, the first flap defines either a second triangular shape or a second trapezoidal shape. In some embodiments, the fourth flap defines a rectangular shape. In some embodiments, the first flap defines a first rectangular shape. In some embodiments, the fourth flap defines either a second triangular shape or a second trapezoidal shape; or the fourth flap defines a second rectangular shape. In some embodiments, the packaging sheet further includes fifth, sixth, seventh, and eighth flaps connected to the first, second, third, and fourth panels, respectively, opposite the first, second, third, and fourth flaps, respectively; wherein the sixth and seventh flaps each define either the first triangular shape or the first trapezoidal shape. In some embodiments, a first edge is defined between the third and fifth panels so that the fifth panel is adjoined to the third panel along the first edge; and wherein the fifth panel defines second and third edges along which no flaps are adjoined. In some embodiments, the first and fifth flaps each define either a second triangular shape or a second trapezoidal shape. In some embodiments, the fourth and eighth flaps each define a rectangular shape. In some embodiments, the first and fifth flaps each define a first rectangular shape. In some embodiments, fourth and eighth flaps each define either a second triangular shape or a second trapezoidal shape; or the fourth and eighth flaps each define a second rectangular shape.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, the second and third flaps each defining a rectangular shape, and the first and fourth flaps each defining a triangular shape; wherein the fourth and fifth panels are spaced in a substantially parallel relation from the first panel when the packaging sheet wraps the article or object, provides structure around the article or object, or forms the box. In some embodiments, a first edge is defined between the third and fifth panels so that the fifth panel is adjoined to the third panel along the first edge; and wherein the fifth panel defines second and third edges along which no flaps are adjoined. In some embodiments, the packaging sheet further includes fifth, sixth, seventh, and eighth flaps connected to the first, second, third, and fourth panels, respectively, opposite the first, second, third, and fourth flaps, respectively; wherein the sixth and seventh flaps each define the rectangular shape and the fifth and eighth flaps each define the triangular shape. In some embodiments, a first edge is defined between the third and fifth panels so that the fifth panel is adjoined to the third panel along the first edge; and wherein the fifth panel defines second and third edges along which no flaps are adjoined.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, along first, second, third, and fourth edges, respectively, the second and third flaps each defining a distal edge extending at a first angle relative to the second and third edges, respectively; wherein the fourth and fifth panels are spaced in a substantially parallel relation from the first panel when the packaging sheet wraps the article or object, provides structure around the article or object, or forms the box. In some embodiments, a fifth edge is defined between the third and fifth panels so that the fifth panel is adjoined to the third panel along the fifth edge; and wherein the fifth panel defines sixth and seventh edges along which no flaps are adjoined. In some embodiments, the first flap defines one or both of: a pair of distal edges each extending at a second angle relative to the first edge; and a distal edge spaced in a parallel relation with the first edge. In some embodiments, the fourth flap defines a distal edge spaced in a parallel relation with the fourth edge. In some embodiments, the first flap defines a distal edge spaced in a parallel relation with the first edge. In some embodiments, the fourth flap defines one or both of: a pair of distal edges each extending at an angle relative to the fourth edge; and a distal edge spaced in a parallel relation with the fourth edge. In some embodiments, the packaging sheet further includes fifth, sixth, seventh, and eighth flaps connected to the first, second, third, and fourth panels, respectively, along fifth, sixth, seventh, and eighth edges, respectively; wherein the sixth and seventh flaps each define a distal edge extending at the first angle relative to the sixth and seventh edges, respectively. In some embodiments, a ninth edge is defined between the third and fifth panels so that the fifth panel is adjoined to the third panel along the ninth edge; and wherein the fifth panel defines tenth and eleventh edges along which no flaps are adjoined. In some embodiments, the first and fifth flaps each define one or both of: a pair of distal edges each extending at a second angle relative to the first or fifth edges, respectively; and a distal edge spaced in a parallel relation with the first or fifth edges, respectively. In some embodiments, the fourth and eighth flaps each define a distal edge spaced in a parallel relation with the fourth or eighth edges, respectively. In some embodiments, the first and fifth flaps each define a distal edge spaced in a parallel relation with the first or fifth edges, respectively. In some embodiments, the fourth and eighth flaps each define one or both of: a pair of distal edges each extending at an angle relative to the fourth or eighth edges, respectively; and a distal edge spaced in a parallel relation with the fourth or eighth edges, respectively.

The present disclosure also introduces a packaging sheet for either wrapping an article or object, providing structure around the article or object, or forming a box, the packaging sheet including first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, along first, second, third, and fourth edges, respectively; the first and fourth flaps each defining a pair of distal edges each extending at an angle relative to the first and fourth edges, respectively, and the second and third flaps each defining a distal edge spaced in a parallel relation with the second and third edges, respectively; wherein the fourth and fifth panels are spaced in a substantially parallel relation from the first panel when the packaging sheet wraps the article or object, provides structure around the article or object, or forms the box; and wherein a fifth edge is defined between the third and fifth panels so that the fifth panel is adjoined to the third panel along the fifth edge; and wherein the fifth panel defines sixth and seventh edges along which no flaps are adjoined. In some embodiments, the packaging sheet further includes fifth, sixth, seventh, and eighth flaps connected to the first, second, third, and fourth panels, respectively, along eighth, ninth, tenth, and eleventh edges, respectively; the fifth and eighth flaps each defining a pair of distal edges each extending at the angle relative to the eighth and eleventh edges, respectively, and the sixth and seventh flaps each defining a distal edge spaced in a parallel relation with the ninth and tenth edges, respectively.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third and fourth panels, respectively, the second and third flaps each defining either a first triangular shape or a first trapezoidal shape;

wherein the fourth and fifth panels are spaced in a substantially parallel relation from the first panel when the packaging sheet wraps the article or object, provides structure around the article or object, or forms the box.

2. The packaging sheet of claim 1, wherein a first edge is defined between the third and fifth panels so that the fifth panel is adjoined to the third panel along the first edge; and wherein the fifth panel defines second and third edges along which no flaps are adjoined.

3. The packaging sheet of claim 1, wherein the first flap defines either a second triangular shape or a second trapezoidal shape.

4. The packaging sheet of claim 3, wherein the fourth flap defines a rectangular shape.

5. The packaging sheet of claim 1, wherein the first flap defines a first rectangular shape.

6. The packing sheet of claim 5, wherein:

the fourth flap defines either a second triangular shape or a second trapezoidal shape; or the fourth flap defines a second rectangular shape.

7. The packaging sheet of claim 1, further comprising:

fifth, sixth, seventh, and eighth flaps connected to the first, second, third, and fourth panels, respectively, opposite the first, second, third, and fourth flaps, respectively;

wherein the sixth and seventh flaps each define either the first triangular shape or the first trapezoidal shape.

8. The packaging sheet of claim 7, wherein a first edge is defined between the third and fifth panels so that the fifth panel is adjoined to the third panel along the first edge; and wherein the fifth panel defines second and third edges along which no flaps are adjoined.

9. The packaging sheet of claim 7, wherein the first and fifth flaps each define either a second triangular shape or a second trapezoidal shape.

10. The packaging sheet of claim 9, wherein the fourth and eighth flaps each define a rectangular shape.

11. The packaging sheet of claim 7, wherein the first and fifth flaps each define a first rectangular shape.

12. The packing sheet of claim 11, wherein:

the fourth and eighth flaps each define either a second triangular shape or a second trapezoidal shape; or the fourth and eighth flaps each define a second rectangular shape.

13. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, the second and third flaps each defining a rectangular shape, and the first and fourth flaps each defining a triangular shape;

wherein the fourth and fifth panels are spaced in a substantially parallel relation from the first panel when the packaging sheet wraps the article or object, provides structure around the article or object, or forms the box.

14. The packaging sheet of claim 13, wherein a first edge is defined between the third and fifth panels so that the fifth panel is adjoined to the third panel along the first edge; and wherein the fifth panel defines second and third edges along which no flaps are adjoined.

15. The packaging sheet of claim 13, further comprising:

fifth, sixth, seventh, and eighth flaps connected to the first, second, third, and fourth panels, respectively, opposite the first, second, third, and fourth flaps, respectively;

wherein the sixth and seventh flaps each define the rectangular shape and the fifth and eighth flaps each define the triangular shape.

16. The packaging sheet of claim 15, wherein a first edge is defined between the third and fifth panels so that the fifth panel is adjoined to the third panel along the first edge; and wherein the fifth panel defines second and third edges along which no flaps are adjoined.

17. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, along first, second, third, and fourth edges, respectively, the second and third flaps each defining a distal edge extending at a first angle relative to the second and third edges, respectively;

wherein the fourth and fifth panels are spaced in a substantially parallel relation from the first panel when the packaging sheet wraps the article or object, provides structure around the article or object, or forms the box.

18. The packaging sheet of claim 17, wherein a fifth edge is defined between the third and fifth panels so that the fifth panel is adjoined to the third panel along the fifth edge; and wherein the fifth panel defines sixth and seventh edges along which no flaps are adjoined.

19. The packaging sheet of claim 17, wherein the first flap defines one or both of:

a pair of distal edges each extending at a second angle relative to the first edge; and a distal edge spaced in a parallel relation with the first edge.

20. The packaging sheet of claim 19, wherein the fourth flap defines a distal edge spaced in a parallel relation with the fourth edge.

21. The packaging sheet of claim 17, wherein the first flap defines a distal edge spaced in a parallel relation with the first edge.

22. The packaging sheet of claim 21, wherein the fourth flap defines one or both of:

a pair of distal edges each extending at an angle relative to the fourth edge; and a distal edge spaced in a parallel relation with the fourth edge.

23. The packaging sheet of claim 17, further comprising:

fifth, sixth, seventh, and eighth flaps connected to the first, second, third, and fourth panels, respectively, along fifth, sixth, seventh, and eighth edges, respectively;

wherein the sixth and seventh flaps each define a distal edge extending at the first angle relative to the sixth and seventh edges, respectively.

24. The packaging sheet of claim 23, wherein a ninth edge is defined between the third and fifth panels so that the fifth panel is adjoined to the third panel along the ninth edge; and wherein the fifth panel defines tenth and eleventh edges along which no flaps are adjoined.

25. The packaging sheet of claim 23, wherein the first and fifth flaps each define one or both of:

a pair of distal edges each extending at a second angle relative to the first or fifth edges, respectively; and a distal edge spaced in a parallel relation with the first or fifth edges, respectively.

26. The packaging sheet of claim 25, wherein the fourth and eighth flaps each define a distal edge spaced in a parallel relation with the fourth or eighth edges, respectively.

27. The packaging sheet of claim 23, wherein the first and fifth flaps each define a distal edge spaced in a parallel relation with the first or fifth edges, respectively.

28. The packaging sheet of claim 27, wherein the fourth and eighth flaps each define one or both of:

a pair of distal edges each extending at an angle relative to the fourth or eighth edges, respectively; and a distal edge spaced in a parallel relation with the fourth or eighth edges, respectively.

29. A packaging sheet for either wrapping an article or object, providing structure around the article or object, or forming a box, the packaging sheet comprising:

first, second, third, fourth, and fifth panels, the second panel being connected to the first panel, the third panel being connected to the first panel opposite the second panel, the fourth panel being connected to the second panel opposite the first panel, and the fifth panel being connected to the third panel opposite the first panel; and first, second, third, and fourth flaps connected to the first, second, third, and fourth panels, respectively, along first, second, third, and fourth edges, respectively;

the first and fourth flaps each defining a pair of distal edges each extending at an angle relative to the first and fourth edges, respectively, and the second and third flaps each defining a distal edge spaced in a parallel relation with the second and third edges, respectively;

wherein the fourth and fifth panels are spaced in a substantially parallel relation from the first panel when the packaging sheet wraps the article or object, provides structure around the article or object, or forms the box; and wherein a fifth edge is defined between the third and fifth panels so that the fifth panel is adjoined to the third panel along the fifth edge; and wherein the fifth panel defines sixth and seventh edges along which no flaps are adjoined.

30. The packaging sheet of claim 29, further comprising:

fifth, sixth, seventh, and eighth flaps connected to the first, second, third, and fourth panels, respectively, along eighth, ninth, tenth, and eleventh edges, respectively;

the fifth and eighth flaps each defining a pair of distal edges each extending at the angle relative to the eighth and eleventh edges, respectively, and the sixth and seventh flaps each defining a distal edge spaced in a parallel relation with the ninth and tenth edges, respectively.

* * * * *